US009728878B2

(12) United States Patent
Shibuya et al.

(10) Patent No.: US 9,728,878 B2
(45) Date of Patent: Aug. 8, 2017

(54) PRESS-FIT TERMINAL AND ELECTRONIC COMPONENT USING THE SAME

(71) Applicant: JX Nippon Mining & Metals Corporation, Tokyo (JP)

(72) Inventors: Yoshitaka Shibuya, Ibaraki (JP); Kazuhiko Fukamachi, Ibaraki (JP); Atsushi Kodama, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 0 days.

(21) Appl. No.: 14/375,333

(22) PCT Filed: Jan. 30, 2013

(86) PCT No.: PCT/JP2013/052102

§ 371 (c)(1),
(2) Date: Jul. 29, 2014

(87) PCT Pub. No.: WO2013/115276

PCT Pub. Date: Aug. 8, 2013

(65) Prior Publication Data

US 2015/0011132 A1 Jan. 8, 2015

(30) Foreign Application Priority Data

Feb. 3, 2012 (JP) ..... 2012-022541

(51) Int. Cl.
*H01R 13/03* (2006.01)
*H01R 12/58* (2011.01)
(Continued)

(52) U.S. Cl.
CPC ..... *H01R 13/03* (2013.01); *C23C 28/023* (2013.01); *C25D 5/12* (2013.01); *C25D 7/00* (2013.01);
(Continued)

(58) Field of Classification Search
CPC ..... H01R 13/03; H01R 43/16
See application file for complete search history.

(56) References Cited

U.S. PATENT DOCUMENTS 3,648,355 A * 3/1972 Shida et al. ..... 228/187
5,075,176 A * 12/1991 Brinkmann ..... 428/647
(Continued)

FOREIGN PATENT DOCUMENTS

EP 0033644 A1 8/1981
JP 61-124597 A 6/1986
(Continued)

OTHER PUBLICATIONS

Office Action for U.S. Appl. No. 14/346,025 dated Oct. 29, 2015.
(Continued)

*Primary Examiner* — Amy Cohen Johnson
*Assistant Examiner* — Oscar C Jimenez
(74) *Attorney, Agent, or Firm* — Drinker Biddle & Reath LLP

(57) ABSTRACT

There are provided a press-fit terminal which has an excellent whisker resistance and a low inserting force, is unlikely to cause shaving of plating when the press-fit terminal is inserted into a substrate, and has a high heat resistance, and an electronic component using the same. A press-fit terminal comprises: a female terminal connection part provided at one side of an attached part to be attached to a housing; and a substrate connection part provided at the other side and attached to a substrate by press-fitting the substrate connection part into a through-hole formed in the substrate. At least the substrate connection part has the surface structure described below, and the press-fit terminal has an excellent whisker resistance. The surface structure comprises: an A layer formed as an outermost surface layer and formed of Sn, In, or an alloy thereof; a B layer formed below the A
(Continued)

layer and constituted of one or two or more selected from the group consisting of Ag, Au, Pt, Pd, Ru, Rh, Os, and Ir; and a C layer formed below the B layer and constituted of one or two or more selected from the group consisting of Ni, Cr, Mn, Fe, Co, and Cu. The A layer has a thickness of 0.002 to 0.2 μm. The B layer has a thickness of 0.001 to 0.3 μm. The C layer has a thickness of 0.05 μm or larger.

14 Claims, 4 Drawing Sheets

(51) Int. Cl.

| | |
|---|---|
| ***C23C 28/02*** | (2006.01) |
| ***C25D 7/00*** | (2006.01) |
| ***C25D 5/12*** | (2006.01) |
| ***C25D 3/50*** | (2006.01) |
| ***C25D 3/54*** | (2006.01) |
| ***C25D 3/30*** | (2006.01) |
| ***C25D 3/60*** | (2006.01) |

(52) U.S. Cl.
CPC ..... *C25D 3/30* (2013.01); *C25D 3/50* (2013.01); *C25D 3/54* (2013.01); *C25D 3/60* (2013.01); *H01R 12/585* (2013.01)

(56) References Cited

U.S. PATENT DOCUMENTS

| | | | | |
|---|---|---|---|---|
| 6,548,898 | B2 | 4/2003 | Matsuki et al. | |
| 7,147,933 | B2 * | 12/2006 | Strobel | 428/647 |
| 7,808,109 | B2 * | 10/2010 | Chen et al. | 257/762 |
| 7,922,545 | B2 * | 4/2011 | Saitoh | 439/751 |
| 8,426,742 | B2 | 4/2013 | Ejiri et al. | |
| 2004/0038072 | A1 | 2/2004 | Miura | |
| 2004/0161626 | A1 | 8/2004 | Kwon et al. | |
| 2005/0106408 | A1 | 5/2005 | Chen et al. | |
| 2005/0176267 | A1 | 8/2005 | Saitoh | |
| 2006/0292847 | A1 | 12/2006 | Schetty | |
| 2008/0188100 | A1 * | 8/2008 | Saitoh | H01R 12/585 439/82 |
| 2010/0255735 | A1 | 10/2010 | Moriuchi et al. | |
| 2011/0012497 | A1 | 1/2011 | Sumiya et al. | |
| 2011/0236712 | A1 | 9/2011 | Masago et al. | |
| 2012/0009496 | A1 * | 1/2012 | Shibuya | 429/455 |
| 2012/0107639 | A1 * | 5/2012 | Takamizawa | C25D 5/10 428/620 |
| 2014/0329107 | A1 | 11/2014 | Shibuya et al. | |
| 2015/0147924 | A1 | 5/2015 | Shibuya et al. | |
| 2015/0171537 | A1 | 6/2015 | Shibuya et al. | |
| 2015/0194746 | A1 | 7/2015 | Shibuya et al. | |
| 2015/0295333 | A1 | 10/2015 | Shibuya et al. | |

FOREIGN PATENT DOCUMENTS

| | | | | |
|---|---|---|---|---|
| JP | 01-306574 | A | 12/1989 | |
| JP | 02-301573 | A | 12/1990 | |
| JP | 04-160200 | A | 6/1992 | |
| JP | 04-370613 | A | 12/1992 | |
| JP | 05-311495 | A | 11/1993 | |
| JP | 09-078287 | A | 3/1997 | |
| JP | 11-121075 | A | 4/1999 | |
| JP | 11-229178 | A | 8/1999 | |
| JP | 11-350188 | A | 12/1999 | |
| JP | 11-350189 | A | 12/1999 | |
| JP | 2003-129278 | A | 5/2003 | |
| JP | 2004-079486 | A | 3/2004 | |
| JP | 2004-176107 | A | 6/2004 | |
| JP | 2004-190065 | A | 7/2004 | |
| JP | 2005-126763 | A | 5/2005 | |
| JP | 2005226089 | A | 8/2005 | |
| JP | 2005-353542 | A | 12/2005 | |
| JP | 2006152389 | A | 6/2006 | |
| JP | 2008-021501 | A | 1/2008 | |
| JP | 2010-138452 | A | 6/2010 | |
| JP | WO 2010119489 | A1 * | 10/2010 | C25D 5/12 |
| JP | 2010262861 | A | 11/2010 | |
| JP | 2011-012320 | A | 1/2011 | |
| JP | 2011-026677 | A | 2/2011 | |
| JP | 2011122234 | A | 6/2011 | |
| JP | 2012-036436 | A | 2/2012 | |
| WO | 2005038989 | A2 | 4/2005 | |
| WO | 2010119489 | A1 | 10/2010 | |
| WO | 2011/001737 | A1 | 1/2011 | |

OTHER PUBLICATIONS

Office Action for U.S. Appl. No. 14/432,978 dated Oct. 27, 2015.
Supplementary European Search Report issued Sep. 2, 2015 for European application No. 13744251.3.
Office Action of U.S. Appl. No. 13/818,455, dated May 16, 2016.
Office Action dated Aug. 22, 2016 in U.S. Appl. No. 14/346,025.
Office Action dated Aug. 22, 2016 in U.S. Appl. No. 14/432,978.

* cited by examiner

PRESS-FIT TERMINAL AND ELECTRONIC COMPONENT USING THE SAME

TECHNICAL FIELD

The present invention relates to a press-fit terminal comprising: a female terminal connection part provided at one side of an attached part to be attached to a housing; and a substrate connection part provided at the other side and attached to a substrate by press-fitting the substrate connection part into a through-hole formed in the substrate, and an electronic component using the same.

BACKGROUND ART

A press-fit terminal is an acicular terminal having compressive elasticity, and is press-fitted into a through-hole formed in a substrate, to ensure a frictional force (retaining force), thereby being mechanically and electrically fixed to the substrate. A copper-plated electrode portion is formed on an inner circumferential surface of a conventional through-hole. The electrode portion contributes to a retaining force between the through-hole and a press-fit terminal pin. A male connector (plug connector) is attached to the press-fit terminal fixed to the substrate, and is fitted to a female connector (receptacle connector), thereby establishing electrical connection. The surface of a terminal for the press-fit terminal is mainly subjected to Sn plating in order to improve a contact property with a through-hole of a connection substrate in light of lead free.

This press-fit terminal connects a connection terminal and a control substrate without performing conventional soldering. It is not assumed that the press-fit terminal once inserted into the through-hole is extracted from the through-hole again. Therefore, as a matter of course, a person cannot insert the terminal for the press-fit terminal into the through-hole with a hand. For example, when the terminal for the press-fit terminal is inserted into the through-hole, a normal force of 6 to 7 kg (60 to 70 N) per terminal is required. A significant pushing force is required in a connector subjected to molding, because 50 to 100 terminals are simultaneously used as the press-fit terminal.

For this reason, when the terminal for the press-fit terminal is inserted into the through-hole, the outer periphery of the press-fit terminal is subjected to a large welding pressure by the through-hole; comparatively soft Sn plating is shaven; and the shaven pieces are dispersed around, which disadvantageously causes short-circuit between the adjacent terminals depending on the case.

By contrast, a press-fit terminal inserted into a conductive through-hole of a substrate in a press-fit state is described in Patent Literature 1. In the press-fit terminal, at least a substrate inserting portion of the press-fit terminal is subjected to tin plating with a thickness of 0.1 to 0.8 μm, and the portion for which the tin plating is carried out is subjected to copper intermediate layer plating with a thickness of 0.5 to 1 μm and nickel base plating with a thickness of 1 to 1.3 μm, thereby to enable the suppression of the shaving of the tin plating.

A press-fit terminal is described in Patent Literature 2. In the press-fit terminal, a base plating layer made of Ni or a Ni alloy is provided on the entire surface of a base material. A Cu—Sn alloy layer and a Sn layer are sequentially provided on the surface of the base plating layer of the female terminal connection part of the base material, or a Cu—Sn alloy layer and a Sn alloy layer are sequentially provided on the surface. Alternatively, a Au alloy layer is provided on the surface. A Cu3Sn alloy layer and a Cu6Sn5 alloy layer are sequentially provided on the surface of the base plating layer of the substrate connection part of the base material, and Sn is not exposed on the surface of the Cu6Sn5 alloy layer. Thereby, the generation of shaving offscum of the Sn plating can be suppressed as compared with Patent Literature 1; and a synergistic effect obtained by providing the soft Sn layer or Sn alloy layer on the hard Cu—Sn alloy layer can improve a coefficient of friction to thereby weaken an inserting force when a terminal for press-fit is inserted into the through-hole.

CITATION LIST

Patent Literature

Patent Literature 1—Japanese Patent Laid-Open No. 2005-226089

Patent Literature 2—Japanese Patent Laid-Open No. 2010-262861

SUMMARY OF INVENTION

Technical Problem

However, in the technique described in Patent Literature 1, whiskers are generated in the mechanical/electrical connection part between the conductive through-hole of the substrate and the press-fit terminal; a sufficiently low inserting force cannot be acquired; the plating is shaven to thereby generate the shaving offscum; and a sufficiently high heat resistance cannot be acquired although a heat resistance has been required at 175° C. in USACAR specification in recent years.

Also in the technique described in Patent Literature 2, a press-fit terminal is not achieved, which has an excellent whisker resistance and a low inserting force, is unlikely to cause shaving of plating when the press-fit terminal is inserted into a substrate, and has a high heat resistance.

Thus, the press-fit terminal subjected to the conventional Sn plating has problems of a whisker resistance, an inserting force, shaving of plating when the press-fit terminal is inserted into the substrate, and a heat resistance.

The present invention has been achieved to solve the above-mentioned problems, and an object thereof is to provide a press-fit terminal which has an excellent whisker resistance and a low inserting force, is unlikely to cause shaving of plating when the press-fit terminal is inserted into the substrate, and has a high heat resistance, and an electronic component using the same.

Solution to Problem

The present inventors have found that a press-fit terminal which has an excellent whisker resistance and a low inserting force can be provided by using a metal material obtained by sequentially forming an A layer, a B layer, and a C layer formed at a predetermined thickness by using a predetermined metal from an outermost surface layer, and thereby a press-fit terminal which is unlikely to cause shaving of plating when the press-fit terminal is inserted into a substrate, and has a high heat resistance can be fabricated.

One aspect of the present invention completed based on the above finding is a press-fit terminal comprising: a female terminal connection part provided at one side of an attached part to be attached to a housing; and a substrate connection part provided at the other side and attached to a substrate by press-fitting the substrate connection part into a through-hole formed in the substrate, wherein at least the substrate connection part has the surface structure described below, and the press-fit terminal has an excellent whisker resistance; the surface structure comprises:

an A layer formed as an outermost surface layer and formed of Sn, In, or an alloy thereof;

a B layer formed below the A layer and constituted of one or two or more selected from the group consisting of Ag, Au, Pt, Pd, Ru, Rh, Os, and Ir; and a C layer formed below the B layer and constituted of one or two or more selected from the group consisting of Ni, Cr, Mn, Fe, Co, and Cu; wherein the A layer has a thickness of 0.002 to 0.2 μm;

the B layer has a thickness of 0.001 to 0.3 μm; and the C layer has a thickness of 0.05 μm or larger.

Another aspect of the present invention is a press-fit terminal comprising: a female terminal connection part provided at one side of an attached part to be attached to a housing; and a substrate connection part provided at the other side and attached to a substrate by press-fitting the substrate connection part into a through-hole formed in the substrate, wherein at least the substrate connection part has the surface structure described below, and the press-fit terminal has a low inserting force; the surface structure comprises:

an A layer formed as an outermost surface layer and formed of Sn, In, or an alloy thereof;

a B layer formed below the A layer and constituted of one or two or more selected from the group consisting of Ag, Au, Pt, Pd, Ru, Rh, Os, and Ir; and a C layer formed below the B layer and constituted of one or two or more selected from the group consisting of Ni, Cr, Mn, Fe, Co, and Cu; wherein the A layer has a thickness of 0.002 to 0.2 μm;

the B layer has a thickness of 0.001 to 0.3 μm; and the C layer has a thickness of 0.05 μm or larger.

Further another aspect of the present invention is a press-fit terminal comprising: a female terminal connection part provided at one side of an attached part to be attached to a housing; and a substrate connection part provided at the other side and attached to a substrate by press-fitting the substrate connection part into a through-hole formed in the substrate, wherein at least the substrate connection part has the surface structure described below, and the press-fit terminal is unlikely to cause shaving of plating when the press-fit terminal is inserted; the surface structure comprises:

an A layer formed as an outermost surface layer and formed of Sn, In, or an alloy thereof;

a B layer formed below the A layer and constituted of one or two or more selected from the group consisting of Ag, Au, Pt, Pd, Ru, Rh, Os, and Ir; and a C layer formed below the B layer and constituted of one or two or more selected from the group consisting of Ni, Cr, Mn, Fe, Co, and Cu; wherein the A layer has a thickness of 0.002 to 0.2 μm;

the B layer has a thickness of 0.001 to 0.3 μm; and the C layer has a thickness of 0.05 μm or larger.

Further another aspect of the present invention is a press-fit terminal comprising: a female terminal connection part provided at one side of an attached part to be attached to a housing; and a substrate connection part provided at the other side and attached to a substrate by press-fitting the substrate connection part into a through-hole formed in the substrate, wherein at least the substrate connection part has the surface structure described below, and the press-fit terminal has an excellent heat resistance; the surface structure comprises:

an A layer formed as an outermost surface layer and formed of Sn, In, or an alloy thereof;

a B layer formed below the A layer and constituted of one or two or more selected from the group consisting of Ag, Au, Pt, Pd, Ru, Rh, Os, and Ir; and a C layer formed below the B layer and constituted of one or two or more selected from the group consisting of Ni, Cr, Mn, Fe, Co, and Cu; wherein the A layer has a thickness of 0.002 to 0.2 μm;

the B layer has a thickness of 0.001 to 0.3 μm; and the C layer has a thickness of 0.05 μm or larger.

Further another aspect of the present invention is a press-fit terminal comprising: a female terminal connection part provided at one side of an attached part to be attached to a housing; and a substrate connection part provided at the other side and attached to a substrate by press-fitting the substrate connection part into a through-hole formed in the substrate, wherein at least the substrate connection part has the surface structure described below, and the press-fit terminal has an excellent whisker resistance; the surface structure comprises:

an A layer formed as an outermost surface layer and formed of Sn, In, or an alloy thereof;

a B layer formed below the A layer and constituted of one or two or more selected from the group consisting of Ag, Au, Pt, Pd, Ru, Rh, Os, and Ir; and a C layer formed below the B layer and constituted of one or two or more selected from the group consisting of Ni, Cr, Mn, Fe, Co, and Cu; wherein the A layer has a deposition amount of Sn, In of 1 to 150 $\mu g/cm^2$;

the B layer has a deposition amount of Ag, Au, Pt, Pd, Ru, Rh, Os, Ir of 1 to 330 $\mu g/cm^2$; and the C layer has a deposition amount of Ni, Cr, Mn, Fe, Co, Cu of 0.03 $mg/cm^2$ or larger.

Further another aspect of the present invention is a press-fit terminal comprising: a female terminal connection part provided at one side of an attached part to be attached to a housing; and a substrate connection part provided at the other side and attached to a substrate by press-fitting the substrate connection part into a through-hole formed in the substrate, wherein at least the substrate connection part has the surface structure described below, and the press-fit terminal has a low inserting force; the surface structure comprises:

an A layer formed as an outermost surface layer and formed of Sn, In, or an alloy thereof;

a B layer formed below the A layer and constituted of one or two or more selected from the group consisting of Ag, Au, Pt, Pd, Ru, Rh, Os, and Ir; and a C layer formed below the B layer and constituted of one or two or more selected from the group consisting of Ni, Cr, Mn, Fe, Co, and Cu; wherein the A layer has a deposition amount of Sn, In of 1 to 150 $\mu g/cm^2$;

the B layer has a deposition amount of Ag, Au, Pt, Pd, Ru, Rh, Os, Ir of 1 to 330 $\mu g/cm^2$; and the C layer has a deposition amount of Ni, Cr, Mn, Fe, Co, Cu of 0.03 $mg/cm^2$ or larger.

Further another aspect of the present invention is a press-fit terminal comprising: a female terminal connection part provided at one side of an attached part to be attached to a housing; and a substrate connection part provided at the other side and attached to a substrate by press-fitting the substrate connection part into a through-hole formed in the substrate, wherein at least the substrate connection part has the surface structure described below, and the press-fit terminal is unlikely to cause shaving of plating when the press-fit terminal is inserted; the surface structure comprises:

an A layer formed as an outermost surface layer and formed of Sn, In, or an alloy thereof;

a B layer formed below the A layer and constituted of one or two or more selected from the group consisting of Ag, Au, Pt, Pd, Ru, Rh, Os, and Ir; and a C layer formed below the B layer and constituted of one or two or more selected from the group consisting of Ni, Cr, Mn, Fe, Co, and Cu; wherein the A layer has a deposition amount of Sn, In of 1 to 150 $\mu g/cm^2$;

the B layer has a deposition amount of Ag, Au, Pt, Pd, Ru, Rh, Os, Ir of 1 to 330 $\mu g/cm^2$; and the C layer has a deposition amount of Ni, Cr, Mn, Fe, Co, Cu of 0.03 $mg/cm^2$ or larger.

Further another aspect of the present invention is a press-fit terminal comprising: a female terminal connection part provided at one side of an attached part to be attached to a housing; and a substrate connection part provided at the other side and attached to a substrate by press-fitting the substrate connection part into a through-hole formed in the substrate, wherein at least the substrate connection part has the surface structure described below, and the press-fit terminal has an excellent heat resistance; the surface structure comprises:

an A layer formed as an outermost surface layer and formed of Sn, In, or an alloy thereof;

a B layer formed below the A layer and constituted of one or two or more selected from the group consisting of Ag, Au, Pt, Pd, Ru, Rh, Os, and Ir; and a C layer formed below the B layer and constituted of one or two or more selected from the group consisting of Ni, Cr, Mn, Fe, Co, and Cu; wherein the A layer has a deposition amount of Sn, In of 1 to 150 $\mu g/cm^2$;

the B layer has a deposition amount of Ag, Au, Pt, Pd, Ru, Rh, Os, Ir of 1 to 330 $\mu g/cm^2$; and the C layer has a deposition amount of Ni, Cr, Mn, Fe, Co, Cu of 0.03 $mg/cm^2$ or larger.

In one embodiment of the press-fit terminal according to the present invention, the A layer has an alloy composition comprising 50 mass % or more of Sn, In, or a total of Sn and In, and the other alloy component(s) comprising one or two or more metals selected from the group consisting of Ag, As, Au, Bi, Cd, Co, Cr, Cu, Fe, In, Mn, Mo, Ni, Pb, Sb, Sn, W, and Zn.

In another embodiment of the press-fit terminal according to the present invention, the B layer has an alloy composition comprising 50 mass % or more of Ag, Au, Pt, Pd, Ru, Rh, Os, Ir, or a total of Ag, Au, Pt, Pd, Ru, Rh, Os, and Ir, and the other alloy component(s) comprising one or two or more metals selected from the group consisting of Ag, Au, Bi, Cd, Co, Cu, Fe, In, Ir, Mn, Mo, Ni, Pb, Pd, Pt, Rh, Ru, Sb, Se, Sn, W, Tl, and Zn.

In further another embodiment of the press-fit terminal according to the present invention, the C layer has an alloy composition comprising 50 mass % or more of a total of Ni, Cr, Mn, Fe, Co, and Cu, and further comprising one or two or more selected from the group consisting of B, P, Sn, and Zn.

In further another embodiment of the press-fit terminal according to the present invention, a Vickers hardness as measured from the surface of the A layer is Hv100 or higher.

In further another embodiment of the press-fit terminal according to the present invention, the A layer has a surface indentation hardness of 1,000 MPa or higher, the indentation hardness being a hardness acquired by measuring an impression made on the surface of the A layer by a load of 0.1 mN in an ultrafine hardness test.

In further another embodiment of the press-fit terminal according to the present invention, a Vickers hardness as measured from the surface of the A layer is Hv1,000 or lower, and the press-fit terminal has high bending workability.

In further another embodiment of the press-fit terminal according to the present invention, the A layer has a surface indentation hardness of 10,000 MPa or lower, the indentation hardness being a hardness acquired by measuring an impression made on the surface of the A layer by a load of 0.1 mN in an ultrafine hardness test, and the press-fit terminal has high bending workability.

In further another embodiment of the press-fit terminal according to the present invention, the A layer has a surface arithmetic average height (Ra) of 0.1 μm or lower.

In further another embodiment of the press-fit terminal according to the present invention, the A layer has a surface maximum height (Rz) of 1 μm or lower.

In further another embodiment of the press-fit terminal according to the present invention, the A layer has a surface reflection density of 0.3 or higher.

In further another embodiment of the press-fit terminal according to the present invention, when a depth analysis by XPS (X-ray photoelectron spectroscopy) is carried out, a position ($D_1$) where an atomic concentration (at %) of Sn or In of the A layer is a maximum value, a position ($D_2$) where an atomic concentration (at %) of Ag, Au, Pt, Pd, Ru, Rh, Os, or Ir of the B layer is a maximum value, and a position ($D_3$) where an atomic concentration (at %) of Ni, Cr, Mn, Fe, Co, or Cu of the C layer is a maximum value are present in the order of $D_1$, $D_2$, and $D_3$ from the outermost surface.

In further another embodiment of the press-fit terminal according to the present invention, when a depth analysis by XPS (X-ray photoelectron spectroscopy) is carried out, the A layer has a maximum value of an atomic concentration (at %) of Sn or In of 10 at % or higher, and the B layer has a maximum value of an atomic concentration (at %) of Ag, Au, Pt, Pd, Ru, Rh, Os, or Ir of 10 at % or higher; and a depth where the C layer has an atomic concentration (at %) of Ni, Cr, Mn, Fe, Co, or Cu of 25% or higher is 50 nm or more.

In further another embodiment of the press-fit terminal according to the present invention, the A layer has a thickness of 0.01 to 0.1 μm.

In further another embodiment of the press-fit terminal according to the present invention, the A layer has a deposition amount of Sn, In of 7 to 75 $\mu g/cm^2$.

In further another embodiment of the press-fit terminal according to the present invention, the B layer has a thickness of 0.005 to 0.1 μm.

In further another embodiment of the press-fit terminal according to the present invention, the B layer has a deposition amount of Ag, Au, Pt, Pd, Ru, Rh, Os, Ir of 4 to 120 $\mu g/cm^2$.

In further another embodiment of the press-fit terminal according to the present invention, the C layer has a cross-section Vickers hardness of Hv300 or higher.

In further another embodiment of the press-fit terminal according to the present invention, the cross-section Vickers hardness and the thickness of the C layer satisfy the following expression:

$$\text{Vickers hardness(Hv)} \geq -376.22 \text{ Ln(thickness:}\mu\text{m)} + 86.411.$$

In further another embodiment of the press-fit terminal according to the present invention, the underlayer (C layer) has a cross-section indentation hardness of 2,500 MPa or higher, the indentation hardness being a hardness acquired by measuring an impression made on the cross-section of the underlayer (C layer) by a load of 0.1 mN in an ultrafine hardness test.

In further another embodiment of the press-fit terminal according to the present invention, the cross-section indentation hardness, which is a hardness acquired by measuring an impression made on the cross-section of the underlayer (C layer) by a load of 0.1 mN in an ultrafine hardness test, and the thickness of the underlayer (C layer) satisfy the following expression:

$$\text{Indentation hardness(MPa)} \geq -3998.4 \text{ Ln(thickness:}\mu\text{m)} + 1178.9.$$

In further another embodiment of the press-fit terminal according to the present invention, the C layer has a cross-section Vickers hardness of Hv1,000 or lower.

In further another embodiment of the press-fit terminal according to the present invention, the underlayer (C layer) has a cross-section indentation hardness of 10,000 MPa or lower, the indentation hardness being a hardness acquired by measuring an impression made on the cross-section of the underlayer (C layer) by a load of 0.1 mN in an ultrafine hardness test.

In further another embodiment of the press-fit terminal according to the present invention, when a depth analysis by XPS (X-ray photoelectron spectroscopy) is carried out, between a position ($D_1$) where an atomic concentration (at %) of Sn or In of the A layer is a maximum value and a position ($D_3$) where an atomic concentration (at %) of Ni, Cr, Mn, Fe, Co, Cu, or Zn of the C layer is a maximum value, a region having 40 at % or more of Ag, Au, Pt, Pd, Ru, Rh, Os, or Ir is present in a thickness of 1 nm or larger.

In further another embodiment of the press-fit terminal according to the present invention, when an elemental analysis of a surface of the A layer is carried out by a survey measurement by XPS (X-ray photoelectron spectroscopy), a content of Sn, In is 2 at % or higher.

In further another embodiment of the press-fit terminal according to the present invention, when an elemental analysis of a surface of the A layer is carried out by a survey measurement by XPS (X-ray photoelectron spectroscopy), a content of Ag, Au, Pt, Pd, Ru, Rh, Os, or Ir is lower than 7 at %.

In further another embodiment of the press-fit terminal according to the present invention, when an elemental analysis of a surface of the A layer is carried out by a survey measurement by XPS (X-ray photoelectron spectroscopy), a content of O is lower than 50 at %.

In further another embodiment of the press-fit terminal according to the present invention, the press-fit terminal is fabricated by forming surface-treated layers on the substrate connection part in the order of the C layer, the B layer, and the A layer by a surface treatment, and thereafter heat-treating the surface-treated layers at a temperature of 50 to 500° C. within 12 hours.

Further another aspect of the present invention is an electronic component comprising the press-fit terminal according to the present invention.

Advantageous Effects of Invention

The present invention can provide a press-fit terminal which has an excellent whisker resistance and a low inserting force, is unlikely to cause shaving of plating when the press-fit terminal is inserted into a substrate, and has a high heat resistance, and an electronic component using the same.

DESCRIPTION OF EMBODIMENTS

Figure 1:
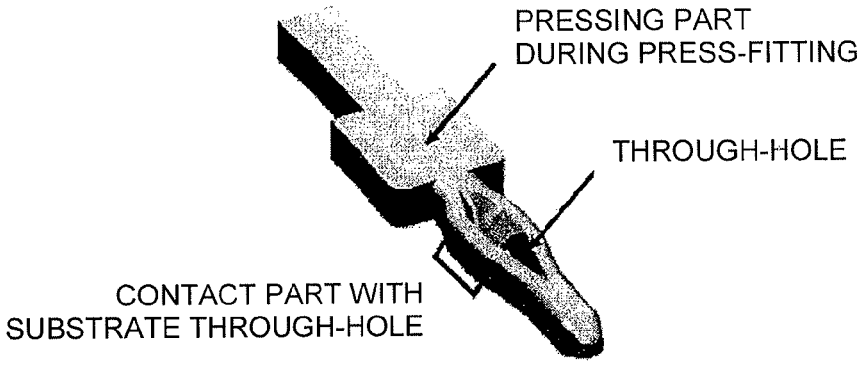
FIG. 1 is an illustrative diagram of a press-fit terminal according to an embodiment of the present invention.
Figure 2:
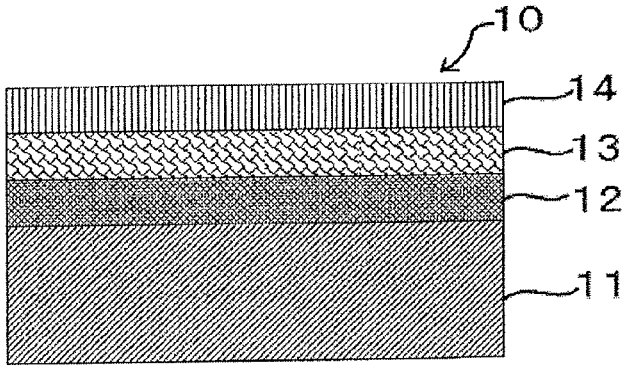
FIG. 2 is an illustrative diagram showing a constitution of a metal material used for the press-fit terminal according to the embodiment of the present invention.

Hereinafter, a press-fit terminal according to an embodiment of the present invention will be described. FIG. 1 is an illustrative diagram of a press-fit terminal according to the embodiment. As shown in FIG. 2, in a metal material 10 used as a material of the press-fit terminal, a C layer 12 is formed on the surface of a base material 11; a B layer 13 is formed on the surface of the C layer 12; and an A layer 14 is formed on the surface of the B layer 13.

Figure 5:
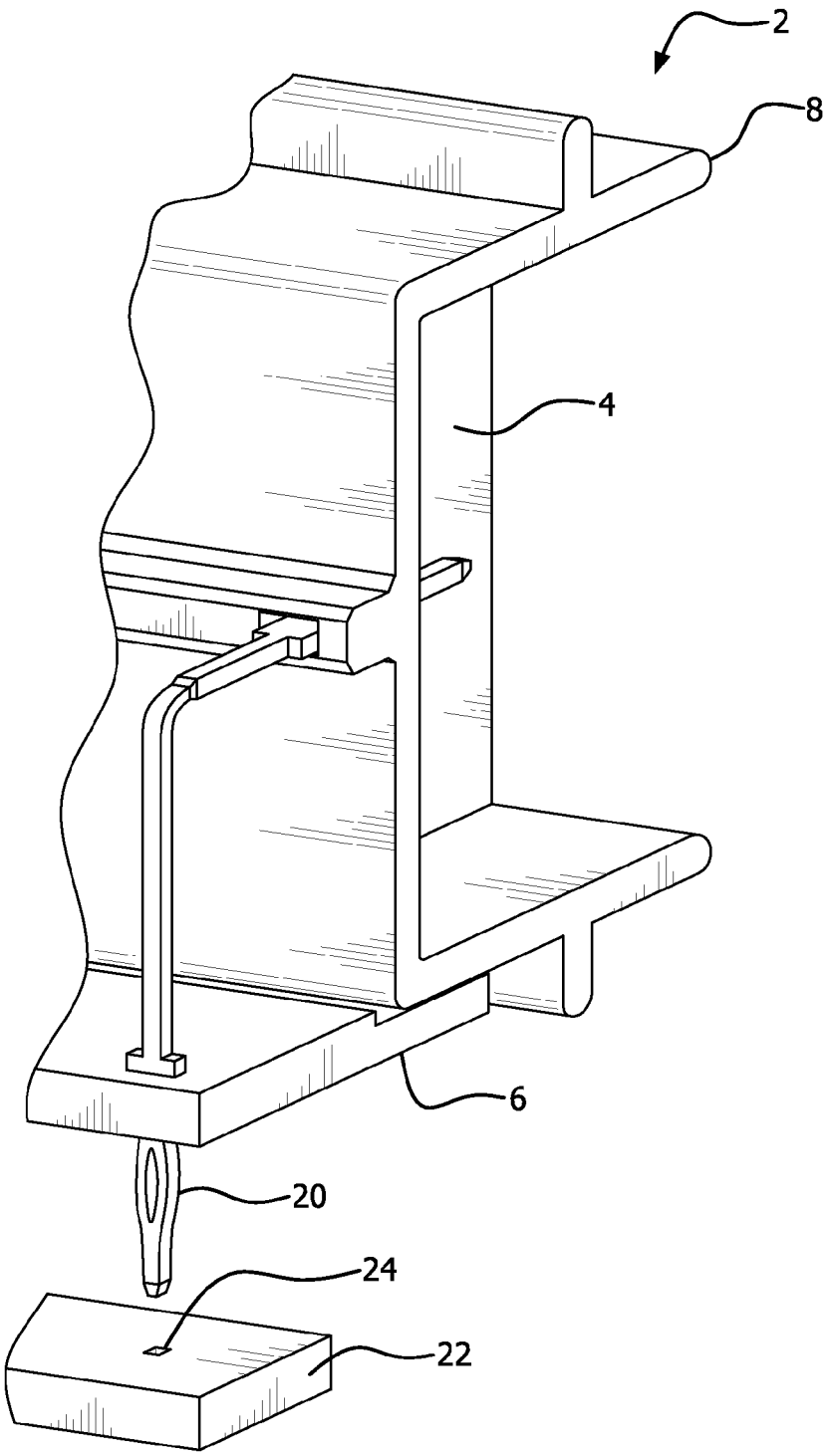
FIG. 5 is a an illustrative drawing of a press-fit terminal according to an embodiment of the invention.

FIG. 5 is a an illustrative drawing of a press-fit terminal according to an embodiment of the invention, generally designated as 2. A female terminal connection part 4 of the press-fit terminal 2 is provided at one side of an attached part 6. Attached part 6 is attached to housing 8. A substrate connection part 20 is provided at the other side of the press-fit terminal 2. The substrate connection part 20 is attached to a substrate 22 by press-fitting the substrate connection part into through-hole 24 formed in the substrate.

Constitution of Press-Fit Terminal

Base Material

The base material 11 is not especially limited, but usable are metal base materials, for example, copper and copper alloys, Fe-based materials, stainless steels, titanium and titanium alloys, and aluminum and aluminum alloys. The structure and shape or the like of the press-fit terminal are not especially limited. A general press-fit terminal includes a plurality of terminals (multi-pin) arranged in parallel, and is fixed to a substrate.

A Layer

The A layer needs to be Sn, In, or an alloy thereof. Sn and In, though being oxidative metals, have a feature of being relatively soft among metals. Therefore, even if an oxide film is formed on the Sn and In surface, when the press-fit terminal is inserted into the substrate, since the oxide film is easily shaven to thereby make the contact of metals, a low contact resistance can be provided.

Sn and In are excellent in the gas corrosion resistance to gases such as chlorine gas, sulfurous acid gas, and hydrogen sulfide gas; and for example, in the case where Ag, inferior in the gas corrosion resistance, is used for the B layer 13; Ni, inferior in the gas corrosion resistance, is used for the C layer 12; and copper and a copper alloy, inferior in the gas corrosion resistance, are used for the base material 11, Sn and In have a function of improving the gas corrosion resistance of the press-fit terminal. Here, among Sn and In, Sn is preferable because In is under a strict regulation based on the technical guideline regarding the health hazard prevention of the Ministry of Health, Labor, and Welfare.

The composition of the A layer 14 comprises 50 mass % or more of Sn, In, or the total of Sn and In, and the other alloy component(s) may be constituted of one or two or more metals selected from the group consisting of Ag, As, Au, Bi, Cd, Co, Cr, Cu, Fe, In, Mn, Mo, Ni, Pb, Sb, Sn, W, and Zn. The composition of the A layer 14 forms an alloy (for example, the A layer is subjected to Sn—Ag plating), and thereby, the composition further improves a whisker resistance, provides a further low inserting force, is further unlikely to cause shaving of plating when the press-fit terminal is inserted into the substrate, and improves a heat resistance in some cases.

The thickness of the A layer 14 needs to be 0.002 to 0.2 μm. The thickness of the A layer 14 is preferably 0.01 to 0.1 μm. With the thickness of the A layer 14 of smaller than 0.002 μm, a sufficient gas corrosion resistance cannot be provided; and when the press-fit terminal is subjected to a gas corrosion test using chlorine gas, sulfurous acid gas, hydrogen sulfide gas, or the like, the press-fit terminal is corroded to thereby largely increase the contact resistance as compared with before the gas corrosion test. In order to provide a more sufficient gas corrosion resistance, the thickness is preferably 0.01 μm or larger. If the thickness becomes large, the adhesive wear of Sn and In becomes much; the inserting force becomes high; and the plating is liable to be shaven when the press-fit terminal is inserted into the substrate. In order to provide a more sufficiently low inserting force and be further unlikely to cause shaving of plating when the press-fit terminal is inserted into the substrate, the thickness is made to be 0.2 μm or smaller. The thickness is more preferably 0.15 μm or smaller, and still more preferably 0.10 μm or smaller.

The deposition amount of Sn, In of the A layer 14 needs to be 1 to 150 $\mu g/cm^2$. The deposition amount of the A layer 14 is preferably 7 to 75 $\mu g/cm^2$. Here, the reason to define the deposition amount will be described. For example, in some cases of measuring the thickness of the A layer 14 by an X-ray fluorescent film thickness meter, due to an alloy layer formed between the A layer and the underneath B layer, an error may be produced in the value of the measured thickness. By contrast, the case of the control using the deposition amount can carry out more exact quality control, not influenced by the formation situation of the alloy layer. If the deposition amount of Sn, In of the A layer 14 is smaller than 1 $\mu g/cm^2$, a sufficient gas corrosion resistance cannot be provided. If the press-fit terminal is subjected to a gas corrosion test using chlorine gas, sulfurous acid gas, hydrogen sulfide gas, or the like, the press-fit terminal is corroded to thereby largely increase the contact resistance as compared with before the gas corrosion test. In order to provide a more sufficient gas corrosion resistance, the deposition amount is preferably 7 $\mu g/cm^2$ or larger. If the deposition amount becomes large, the adhesive wear of Sn and In becomes much; the inserting force becomes high; and the plating is liable to be shaven when the press-fit terminal is inserted into the substrate. In order to provide a more sufficiently low inserting force and be further unlikely to cause shaving of plating when the press-fit terminal is inserted into the substrate, the deposition amount is made to be 150 $\mu g/cm^2$ or smaller. The deposition amount is more preferably 110 $\mu g/cm^2$ or smaller, and still more preferably 75 $\mu g/cm^2$ or smaller.

B Layer

The B layer 13 needs to be constituted of one or two or more selected from the group consisting of Ag, Au, Pt, Pd, Ru, Rh, Os, and Ir. Ag, Au, Pt, Pd, Ru, Rh, Os, and Ir have a feature of relatively having a heat resistance among metals. Therefore, the B layer suppresses the diffusion of the compositions of the base material 11 and the C layer 12 to the A layer 14 side, and improves the heat resistance. These metals form compounds with Sn and In of the A layer 14 and suppress the oxide film formation of Sn and In. Among Ag, Au, Pt, Pd, Ru, Rh, Os, and Ir, Ag is more desirable from the viewpoint of the conductivity. Ag has high conductivity. For example, in the case of using Ag for applications of high-frequency signals, the skin effect reduces the impedance resistance.

The alloy composition of the B layer 13 comprises 50 mass % or more of Ag, Au, Pt, Pd, Ru, Rh, Os, Ir, or the total of Ag, Au, Pt, Pd, Ru, Rh, Os, and Ir, and the other alloy component(s) may be constituted of one or two or more metals selected from the group consisting of Ag, Au, Bi, Cd, Co, Cu, Fe, In, Ir, Mn, Mo, Ni, Pb, Pd, Pt, Rh, Ru, Sb, Se, Sn, W, Tl, and Zn. The composition of the B layer 13 forms an alloy (for example, the B layer is subjected to Ag—Sn plating), and thereby, the composition further improves a whisker resistance, provides a further low inserting force, is further unlikely to cause shaving of plating when the press-fit terminal is inserted into the substrate, and improves a heat resistance in some cases.

The thickness of the B layer 13 needs to be 0.001 to 0.3 μm. The thickness of the B layer 13 is preferably 0.005 to 0.1 μm. If the thickness is smaller than 0.001 μm, the base material 11 or the C layer 12 and the A layer form an alloy, and the contact resistance after a heat resistance test becomes worsened. In order to provide a more sufficient heat resistance, the thickness is preferably 0.005 μm or larger. If the thickness becomes large, the inserting force becomes high; and the plating is liable to be shaven when the press-fit terminal is inserted into the substrate. In order to provide a more sufficiently low inserting force and be further unlikely to cause shaving of plating when the press-fit terminal is inserted into the substrate, the thickness is 0.3 μm or smaller, more preferably 0.15 μm or smaller, and more preferably 0.10 μm or smaller.

The deposition amount of Ag, Au, Pt, Pd, Ru, Rh, Os, Ir, or an alloy thereof of the B layer 13 needs to be 1 to 330 $\mu g/cm^2$. The deposition amount of the B layer 13 is preferably 4 to 120 $\mu g/cm^2$. Here, the reason to define the deposition amount will be described. For example, in some cases of measuring the thickness of the B layer 13 by an X-ray fluorescent film thickness meter, due to an alloy layer formed between the A layer 14 and the underneath B layer 13, an error may be produced in the value of the measured thickness. By contrast, the case of the control using the deposition amount can carry out more exact quality control, not influenced by the formation situation of the alloy layer. With the deposition amount of smaller than 1 $\mu g/cm^2$, the base material 11 or the C layer 12 and the A layer form an alloy, and the contact resistance after a heat resistance test becomes worsened. In order to provide a more sufficient heat resistance, the deposition amount is preferably 4 $\mu g/cm^2$ or larger. If the deposition amount is large, the inserting force becomes high; and the plating is liable to be shaven when the press-fit terminal is inserted into the substrate. In order to provide a more sufficiently low inserting force and be further unlikely to cause shaving of plating when the press-fit terminal is inserted into the substrate, the deposition amount is 330 μg/cm$^2$ or smaller, more preferably 180 μg/cm$^2$ or smaller, and still more preferably 120 μg/cm$^2$ or smaller.

C Layer

Between the base material 11 and the B layer 13, the C layer 12 constituted of one or two or more selected from the group consisting of Ni, Cr, Mn, Fe, Co, and Cu needs to be formed. By forming the C layer 12 by using one or two or more metals selected from the group consisting of Ni, Cr, Mn, Fe, Co, and Cu, the thin film lubrication effect is improved due to the formation of the hard C layer, and thereby a sufficiently low inserting force can be provided. The C layer 12 prevents the diffusion of constituting metals of the base material 11 to the B layer to thereby improve the durability including the suppression of the increase in the contact resistance after the heat resistance test and the gas corrosion resistance test.

The alloy composition of the C layer 12 comprises 50 mass % or more of the total of Ni, Cr, Mn, Fe, Co, and Cu, and may further comprise one or two or more selected from the group consisting of B, P, Sn, and Zn. By making the alloy composition of the C layer 12 to have such a constitution, the C layer is further hardened to thereby further improve the thin film lubrication effect to provide the low inserting force; and the alloying of the C layer 12 further prevents the diffusion of constituting metals of the base material 11 to the B layer to thereby improve the durability including the suppression of the increase in the contact resistance after the heat resistance test and the gas corrosion resistance test.

The thickness of the C layer 12 needs to be 0.05 μm or larger. With the thickness of the C layer 12 of smaller than 0.05 μm, the thin film lubrication effect by the hard C layer decreases to thereby provide the high inserting force; and the constituting metals of the base material 11 become liable to diffuse to the B layer to thereby worsen the durability including the increase in the contact resistance after the heat resistance test and the gas corrosion resistance test.

The deposition amount of Ni, Cr, Mn, Fe, Co, Cu of the C layer 12 needs to be 0.03 mg/cm$^2$ or larger. Here, the reason to define the deposition amount will be described. For example, in some cases of measuring the thickness of the C layer 12 by an X-ray fluorescent film thickness meter, due to alloy layers formed with the A layer 14, the B layer 13, the base material 11, or the like, an error may be produced in the value of the measured thickness. By contrast, the case of the control using the deposition amount can carry out more exact quality control, not influenced by the formation situation of the alloy layer. With the deposition amount of smaller than 0.03 mg/cm$^2$, the thin film lubrication effect by the hard C layer decreases to thereby provide the high inserting force; and the constituting metals of the base material 11 become liable to diffuse to the B layer to thereby worsen the durability including the increase in the contact resistance after the heat resistance test and the gas corrosion resistance test.

Heat Treatment

After the A layer 14 is formed, for the purpose of further improving a whisker resistance, providing a further low inserting force, being further unlikely to cause shaving of plating when the press-fit terminal is inserted into the substrate, or improving a heat resistance, a heat treatment may be carried out. The heat treatment makes it easy for the A layer 14 and the B layer 13 to form an alloy layer to thereby improve the whisker resistance, to be thereby further unlikely to cause shaving of plating when the press-fit terminal is inserted into the substrate, to thereby improve the heat resistance, and to thereby provide further low adhesion of Sn to provide a low inserting force. Here, the heat treatment is not limited. However, the heat treatment is preferably carried out at a temperature of 50 to 500° C. within 12 hours. If the temperature is lower than 50° C., the A layer 14 and the B layer 13 hardly form the alloy layer because of the low temperature. If the temperature is higher than 500° C., the base material 11 or the C layer 12 diffuses to the B layer 13 and the A layer 14 to thereby provide the high contact resistance in some cases. If the heat treatment time is longer than 12 hours, the base material 11 or the C layer 12 diffuses to the B layer 13 and the A layer 14 to thereby provide the high contact resistance in some cases.

Post-Treatment

On the A layer 14 or after the heat treatment is carried out on the A layer 14, for the purpose of providing a further low inserting force, being further unlikely to cause shaving of plating when the press-fit terminal is inserted into the substrate, and improving a heat resistance, a post-treatment may be carried out. The post-treatment improves the lubricity, to thereby provide a further low inserting force, makes shaving of plating unlikely to be caused, and suppresses the oxidation of the A layer and the B layer, to thereby improve the durability such as a heat resistance and a gas corrosion resistance. The post-treatment specifically includes a phosphate salt treatment, a lubrication treatment, and a silane coupling treatment, using inhibitors. Here, the post-treatment is not limited.

Properties of Metal Material

The Vickers hardness as measured from the surface of the A layer 14 is preferably Hv100 or higher. With the Vickers hardness as measured from the surface of the A layer 14 of Hv100 or higher, the hard A layer improves the thin film lubrication effect and provides the low inserting force. By contrast, the Vickers hardness as measured from the surface of the A layer 14 is preferably Hv1,000 or lower. With the Vickers hardness as measured from the surface of the A layer 14 of Hv1,000 or lower, the bending workability is improved; and in the case where the press-fit terminal according to the present invention is press-formed, cracks are hardly generated in the formed portion, and the decrease in the gas corrosion resistance is suppressed.

The indentation hardness as measured from the surface of the A layer 14 is preferably 1,000 MPa or higher. Here, the indentation hardness as measured from the surface of the A layer 14 is a hardness acquired by measuring an impression made on the surface of the A layer by a load of 0.1 mN in an ultrafine hardness test. With the surface indentation hardness of the A layer 14 of 1,000 MPa or higher, the hard A layer improves the thin film lubrication effect and provides a low inserting force. By contrast, the Vickers indentation hardness as measured from the surface of the A layer 14 is preferably 10,000 MPa or lower. With the surface indentation hardness of the A layer 14 of 10,000 MPa or lower, the bending workability is improved; and in the case where the press-fit terminal according to the present invention is press-formed, cracks are hardly generated in the formed portion, and the decrease in the gas corrosion resistance is suppressed.

The arithmetic average height (Ra) of the surface of the A layer 14 is preferably 0.1 μm or lower. With the arithmetic average height (Ra) of the surface of the A layer 14 of 0.1 μm or lower, since convex portions, which are relatively easily corroded, become few and the surface becomes smooth, the gas corrosion resistance is improved.

The maximum height (Rz) of the surface of the A layer 14 is preferably 1 μm or lower. With the maximum height (Rz)

of the surface of the A layer 14 of 1 μm or lower, since convex portions, which are relatively easily corroded, become few and the surface becomes smooth, the gas corrosion resistance is improved.

The surface reflection density of the A layer 14 is preferably 0.3 or higher. With the surface reflection density of the A layer 14 of 0.3 or higher, since convex portions, which are relatively easily corroded, become few and the surface becomes smooth, the gas corrosion resistance is improved.

The cross-section Vickers hardness of the C layer 12 is preferably Hv300 or higher. With the cross-section Vickers hardness of the C layer 12 of Hv300 or higher, the C layer is further hardened to thereby further improve the thin film lubrication effect to provide a low inserting force. By contrast, the cross-section Vickers hardness of the C layer 12 is preferably Hv1,000 or lower. With the cross-section Vickers hardness of the C layer 12 of Hv1,000 or lower, the bending workability is improved; and in the case where the press-fit terminal according to the present invention is press-formed, cracks are hardly generated in the formed portion, and the decrease in the gas corrosion resistance is suppressed.

The cross-section Vickers hardness of the C layer 12 and the thickness of the C layer 12 preferably satisfy the following expression:

$$\text{Vickers hardness(Hv)} \geq -376.22\ \text{Ln(thickness:}\mu\text{m)} + 86.411.$$

If the cross-section Vickers hardness of the C layer 12 and the thickness of the C layer 12 satisfy the above expression, the C layer is further hardened to thereby further improve the thin film lubrication effect to provide the low inserting force.

Here, in the present invention, "Ln (thickness: μm)" refers to a numerical value of a natural logarithm of a thickness (μm).

The cross-section indentation hardness of the C layer 12 is preferably 2,500 MPa or higher. Here, the cross-section indentation hardness of the C layer 12 is a hardness acquired by measuring an impression made on the cross-section of the C layer 12 by a load of 0.1 mN in an ultrafine hardness test. With the cross-section indentation hardness of the C layer 12 of 2,500 MPa or higher, the C layer is further hardened to thereby further improve the thin film lubrication effect to provide the low inserting force. By contrast, the cross-section indentation hardness of the C layer 12 is preferably 10,000 MPa or lower. With the cross-section indentation hardness of the C layer 12 of 10,000 MPa or lower, the bending workability is improved; and in the case where the press-fit terminal according to the present invention is press-formed, cracks are hardly generated in the formed portion, and the decrease in the gas corrosion resistance is suppressed.

The cross-section indentation hardness of the C layer 12 and the thickness of the C layer 12 preferably satisfy the following expression:

$$\text{Indentation hardness(MPa)} \geq -3998.4\ \text{Ln(thickness:}\mu\text{m)} + 1178.9.$$

If the cross-section indentation hardness of the C layer 12 and the thickness of the C layer 12 satisfy the above expression, the C layer is further hardened to thereby further improve the thin film lubrication effect to provide the low inserting force.

When a depth analysis by XPS (X-ray photoelectron spectroscopy) is carried out, it is preferable that a position ($D_1$) where the atomic concentration (at %) of Sn or In of the A layer 14 is a maximum value, a position ($D_2$) where the atomic concentration (at %) of Ag, Au, Pt, Pd, Ru, Rh, Os, or Ir of the B layer 13 is a maximum value, and a position ($D_3$) where the atomic concentration (at %) of Ni, Cr, Mn, Fe, Co, or Cu of the C layer 12 is a maximum value are present in the order of $D_1$, $D_2$, and $D_3$ from the outermost surface. If the positions are not present in the order of $D_1$, $D_2$, and $D_3$ from the outermost surface, there arises a risk that: a sufficient gas corrosion resistance cannot be provided; and when the press-fit terminal is subjected to a gas corrosion test using chlorine gas, sulfurous acid gas, hydrogen sulfide gas, or the like, the press-fit terminal is corroded to thereby largely increase the contact resistance as compared with before the gas corrosion test.

When a depth analysis by XPS (X-ray photoelectron spectroscopy) is carried out, it is preferable that: the A layer 14 has a maximum value of an atomic concentration (at %) of Sn or In of 10 at % or higher, and the B layer 13 has a maximum value of an atomic concentration (at %) of Ag, Au, Pt, Pd, Ru, Rh, Os, or Ir of 10 at % or higher; and a depth where the atomic concentration (at %) of Ni, Cr, Mn, Fe, Co, or Cu of the C layer 12 is 25 at % or higher is 50 nm or more. In the case where the maximum value of the atomic concentration (at %) of Sn or In of the A layer 14, and the maximum value of the atomic concentration (at %) of Ag, Au, Pt, Pd, Ru, Rh, Os, or Ir of the B layer 13 are each lower than 10 at %; and where a depth where the atomic concentration (at %) of Ni, Cr, Mn, Fe, Co, or Cu of the C layer 12 is 25 at % or higher is shallower than 50 nm, there arises a risk that the inserting force is high, and the base material components diffuse to the A layer 14 or the B layer 13 to thereby worsen the heat resistance and the gas corrosion resistance.

When a depth analysis by XPS (X-ray photoelectron spectroscopy) is carried out, it is preferable that between a position ($D_1$) where the atomic concentration (at %) of Sn or In of the A layer 14 is a maximum value and a position ($D_3$) where the atomic concentration (at %) of Ni, Cr, Mn, Fe, Co, Cu, or Zn of the C layer 12 is a maximum value, a region having 40 at % or more of Ag, Au, Pt, Pd, Ru, Rh, Os, or Ir is present in a thickness of 1 nm or larger. If the region is present in a thickness of smaller than 1 nm, for example, in the case of Ag, there arises a risk of worsening the heat resistance.

When an elemental analysis of the surface of the A layer is carried out by a survey measurement by XPS (X-ray photoelectron spectroscopy), it is preferable that the content of Sn, In is 2 at % or higher. If the content of Sn, In is lower than 2 at %, for example, in the case of Ag, there arises a risk that the sulfurization resistance is inferior and the contact resistance largely increases. For example, in the case of Pd, there arises a risk that Pd is oxidized to thereby raise the contact resistance.

When an elemental analysis of the surface of the A layer is carried out by a survey measurement by XPS (X-ray photoelectron spectroscopy), it is preferable that the content of Ag, Au, Pt, Pd, Ru, Rh, Os, or Ir is lower than 7 at %. If the content of Ag, Au, Pt, Pd, Ru, Rh, Os, or Ir is 7 at % or higher, for example, in the case of Ag, there arises a risk that the sulfurization resistance is inferior and the contact resistance largely increases. For example, in the case of Pd, there arises a risk that Pd is oxidized to thereby raise the contact resistance.

When an elemental analysis of the surface of the A layer is carried out by a survey measurement by XPS (X-ray photoelectron spectroscopy), it is preferable that the content of O is lower than 50 at %. If the content of O is 50 at % or higher, there arises a risk of raising the contact resistance.

Method for Manufacturing a Press-Fit Terminal

A method for manufacturing the press-fit terminal according to the present invention is not limited. The press-fit terminal can be manufactured by subjecting a base material previously formed into a press-fit terminal shape by press-forming or the like to wet (electro-, electroless) plating, dry (sputtering, ion plating, or the like) plating, or the like.

Examples

Hereinafter, although Examples of the present invention will be described with Comparative Examples, these are provided to better understand the present invention, and are not intended to limit the present invention.

As Examples and Comparative Examples, samples to be formed by providing a base material, a C layer, a B layer, and an A layer in this order, and possibly heat-treating the resultant, were each fabricated under the conditions shown in the following Tables 1 to 7.

Specifications of press-fit terminals and through-holes are shown in Table 1; the fabrication condition of C layers is shown in Table 2; the fabrication condition of B layers is shown in Table 3; the fabrication condition of A layers is shown in Table 4; and the heat treatment condition is shown in Table 5. The fabrication conditions and the heat treatment conditions of the each layer used in each Example are shown in Table 6; and the fabrication conditions and the heat treatment conditions of the each layer used in each Comparative Example are shown in Table 7.

TABLE 1

| Specification of Press-Fit Terminal | Specification of Through-Hole |
|---|---|
| made by Tokiwa & Co., Inc., Press-fit terminal PCB connector, R800 | Thickness of substrate: 2 mm<br>through-hole: Φ 1 mm |

TABLE 2

Condition of Underlayers (C Layers)

| No. | Surface Treatment Method | Detail |
|---|---|---|
| 1 | Electroplating | Plating liquid: Ni sulfamate plating liquid<br>Plating temperature: 55° C.<br>Current density: 0.5 to 4 A/dm$^2$ |
| 2 | Electroplating | Plating liquid: Cu sulfate plating liquid<br>Plating temperature: 30° C.<br>Current density: 2.3 A/dm$^2$ |
| 3 | Electroplating | Plating liquid: chromium sulfate liquid<br>Plating temperature: 30° C.<br>Current density: 4 A/dm$^2$ |
| 4 | Sputtering | Target: having a predetermined composition<br>Apparatus: sputtering apparatus made by Ulvac, Inc.<br>Output: DC 50 W<br>Argon pressure: 0.2 Pa |
| 5 | Electroplating | Plating liquid: Fe sulfate liquid<br>Plating temperature: 30° C.<br>Current density: 4 A/dm$^2$ |
| 6 | Electroplating | Plating liquid: Co sulfate bath<br>Plating temperature: 30° C.<br>Current density: 4 A/dm$^2$ |
| 7 | Electroplating | Plating liquid: Ni sulfamate plating liquid + saccharin<br>Plating temperature: 55° C.<br>Current density: 4 A/dm$^2$ |
| 8 | Electroplating | Plating liquid: Ni sulfamate plating liquid + saccharin + additive<br>Plating temperature: 55° C.<br>Current density: 4 A/dm$^2$ |

TABLE 3

Condition of Middle Layers (B Layers)

| No. | Surface Treatment Method | Detail |
|---|---|---|
| 1 | Electroplating | Plating liquid: Ag cyanide plating liquid<br>Plating temperature: 40° C.<br>Current density: 0.2 to 4 A/dm$^2$ |
| 2 | Electroplating | Plating liquid: Au cyanide plating liquid<br>Plating temperature: 40° C.<br>Current density: 0.2 to 4 A/dm$^2$ |
| 3 | Electroplating | Plating liquid: chloroplatinic acid plating liquid<br>Plating temperature: 40° C.<br>Current density: 0.2 to 4 A/dm$^2$ |
| 4 | Electroplating | Plating liquid: diammine palladium (II) chloride plating liquid<br>Plating temperature: 40° C.<br>Current density: 0.2 to 4 A/dm$^2$ |
| 5 | Electroplating | Plating liquid: Ru sulfate plating liquid<br>Plating temperature: 40° C.<br>Current density: 0.2 to 4 A/dm$^2$ |
| 6 | Sputtering | Target: having a predetermined composition<br>Apparatus: sputtering apparatus made by Ulvac, Inc.<br>Output: DC 50 W<br>Argon pressure: 0.2 Pa |
| 7 | Electroplating | Plating liquid: Sn methanesulfonate plating liquid<br>Plating temperature: 40° C.<br>Current density: 0.2 to 4 A/dm$^2$ |
| 8 | Electroplating | Plating liquid: Cu sulfate plating liquid<br>Plating temperature: 30° C.<br>Current density: 2.3 A/dm$^2$ |

TABLE 4

Condition of Base Material of Outermost Surface Layers (A Layers)

| No. | Surface Treatment Method | Detail |
|---|---|---|
| 1 | Electroplating | Plating liquid: Sn methanesulfonate plating liquid<br>Plating temperature: 40° C.<br>Current density: 0.2 to 4 A/dm$^2$ |
| 2 | Sputtering | Target: having a predetermined composition<br>Apparatus: sputtering apparatus made by Ulvac, Inc.<br>Output: DC 50 W<br>Argon pressure: 0.2 Pa |
| 3 | Electroplating | Plating liquid: Ag cyanide plating liquid<br>Plating temperature: 40° C.<br>Current density: 0.2 to 4 A/dm$^2$ |

TABLE 5

Heat Treatment Condition

| No. | Temperature [° C.] | Time [second] |
|---|---|---|
| 1 | 300 | 5 |
| 2 | 300 | 20 |
| 3 | 30 | 12 hours |
| 4 | 50 | 12 hours |
| 5 | 50 | 20 hours |
| 6 | 300 | 3 |
| 7 | 500 | 1 |
| 8 | 600 | 1 |

TABLE 6

| Example No. | Outermost Surface Layer (A Layer) Condition No. see Table 4 | Middle Layer (B Layer) Condition No. see Table 3 | Underlayer (C Layer) Condition No. see Table 2 | Heat Treatment Condition No. see Table 5 |
|---|---|---|---|---|
| 1 | 1 | 1 | 1 | — |
| 2 | 1 | 1 | 1 | — |
| 3 | 1 | 1 | 1 | — |
| 4 | 1 | 1 | 1 | — |
| 5 | 1 | 1 | 1 | — |
| 6 | 2 | 1 | 1 | — |
| 7 | 2 | 1 | 1 | — |
| 8 | 2 | 1 | 1 | — |
| 9 | 2 | 1 | 1 | — |
| 10 | 2 | 1 | 1 | — |
| 11 | 2 | 1 | 1 | — |
| 12 | 2 | 1 | 1 | — |
| 13 | 2 | 1 | 1 | — |
| 14 | 2 | 1 | 1 | — |
| 15 | 2 | 1 | 1 | — |
| 16 | 2 | 1 | 1 | — |
| 17 | 2 | 1 | 1 | — |
| 18 | 2 | 1 | 1 | — |
| 19 | 2 | 1 | 1 | — |
| 20 | 2 | 1 | 1 | — |
| 21 | 2 | 1 | 1 | — |
| 22 | 2 | 1 | 1 | — |
| 23 | 2 | 1 | 1 | — |
| 24 | 1 | 2 | 1 | — |
| 25 | 1 | 3 | 1 | — |
| 26 | 1 | 4 | 1 | — |
| 27 | 1 | 5 | 1 | — |
| 28 | 1 | 6 | 1 | — |
| 29 | 1 | 6 | 1 | — |
| 30 | 1 | 6 | 1 | — |
| 31 | 1 | 6 | 1 | — |
| 32 | 1 | 6 | 1 | — |
| 33 | 1 | 6 | 1 | — |
| 34 | 1 | 6 | 1 | — |
| 35 | 1 | 6 | 1 | — |
| 36 | 1 | 6 | 1 | — |
| 37 | 1 | 6 | 1 | — |
| 38 | 1 | 6 | 1 | — |
| 39 | 1 | 6 | 1 | — |
| 40 | 1 | 6 | 1 | — |
| 41 | 1 | 6 | 1 | — |
| 42 | 1 | 6 | 1 | — |
| 43 | 1 | 6 | 1 | — |
| 44 | 1 | 6 | 1 | — |
| 45 | 1 | 6 | 1 | — |
| 46 | 1 | 6 | 1 | — |
| 47 | 1 | 6 | 1 | — |
| 48 | 1 | 6 | 1 | — |
| 49 | 1 | 6 | 1 | — |
| 50 | 1 | 6 | 1 | — |
| 51 | 1 | 6 | 1 | — |
| 52 | 1 | 6 | 1 | — |
| 53 | 1 | 1 | 3 | — |
| 54 | 1 | 1 | 4 | — |
| 55 | 1 | 1 | 5 | — |
| 56 | 1 | 1 | 6 | — |
| 57 | 1 | 1 | 2 | — |
| 58 | 1 | 1 | 4 | — |
| 59 | 1 | 1 | 4 | — |
| 60 | 1 | 1 | 4 | — |
| 61 | 1 | 1 | 4 | — |
| 62 | 1 | 1 | 4 | — |
| 63 | 1 | 1 | 4 | — |
| 64 | 1 | 1 | 4 | — |
| 65 | 1 | 1 | 4 | — |
| 66 | 1 | 1 | 4 | — |
| 67 | 1 | 1 | 1 | — |
| 68 | 1 | 1 | 7 | — |
| 69 | 1 | 1 | 8 | — |
| 70 | 1 | 1 | 1 | — |
| 71 | 1 | 1 | 1 | — |
| 72 | 1 | 1 | 1 | — |
| 73 | 1 | 1 | 1 | — |

TABLE 6-continued

| Example No. | Outermost Surface Layer (A Layer) Condition No. see Table 4 | Middle Layer (B Layer) Condition No. see Table 3 | Underlayer (C Layer) Condition No. see Table 2 | Heat Treatment Condition No. see Table 5 |
|---|---|---|---|---|
| 74 | 1 | 1 | 1 | — |
| 75 | 1 | 1 | 1 | — |
| 76 | 1 | 1 | 1 | — |
| 77 | 1 | 1 | 1 | — |
| 78 | 1 | 1 | 1 | — |
| 79 | 1 | 1 | 1 | — |
| 80 | 1 | 1 | 1 | — |
| 81 | 1 | 1 | 7 | — |
| 82 | 1 | 1 | 8 | — |
| 83 | 1 | 1 | 7 | — |
| 84 | 1 | 1 | 7 | — |
| 85 | 1 | 1 | 8 | — |
| 86 | 1 | 1 | 8 | — |
| 87 | 1 | 1 | 4 | — |
| 88 | 1 | 1 | 4 | — |
| 89 | 1 | 1 | 1 | 1 |
| 90 | 1 | 1 | 1 | 2 |
| 91 | 1 | 2 | 1 | — |
| 92 | 1 | 2 | 1 | — |
| 93 | 2 | 1 | 1 | — |
| 94 | 2 | 1 | 1 | — |
| 95 | 1 | 1 | 1 | — |
| 96 | 1 | 1 | 1 | 3 |
| 97 | 1 | 1 | 1 | 4 |
| 98 | 1 | 1 | 1 | 5 |
| 99 | 1 | 1 | 1 | 6 |
| 100 | 1 | 1 | 1 | 7 |
| 101 | 1 | 1 | 1 | 8 |

TABLE 7

| Comparative Example No. | Outermost Surface Layer (A Layer) Condition No. see Table 4 | Middle Layer (B Layer) Condition No. see Table 3 | Underlayer (C Layer) Condition No. see Table 2 | Heat Treatment Condition No. see Table 5 |
|---|---|---|---|---|
| 1 | 1 | — | 1 | 1 |
| 2 | 1 | — | 1 | 1 |
| 3 | 1 | — | 1 | — |
| 4 | 1 | 8 | 1 | 1 |
| 5 | 1 | 8 | 1 | 1 |
| 6 | 1 | 8 | 1 | — |
| 7 | 1 | — | 2 | 1 |
| 8 | 1 | — | 1 | 1 |
| 9 | 1 | 1 | 1 | — |
| 10 | 1 | 1 | 1 | — |
| 11 | 1 | 1 | 1 | — |
| 12 | 1 | — | 1 | — |
| 13 | 1 | 1 | 1 | — |
| 14 | 1 | — | 1 | — |
| 15 | 1 | 1 | 1 | — |
| 16 | 1 | 1 | 1 | — |
| 17 | 3 | 7 | 1 | — |
| 18 | 1 | 1 | 1 | — |
| 19 | 1 | — | 1 | — |

Measurement of a Thickness

The thicknesses of an A layer, a B layer, and a C layer were measured by carrying out the each surface treatment on a base material, and measuring respective actual thicknesses by an X-ray fluorescent film thickness meter (made by Seiko Instruments Inc., SEA5100, collimator: 0.1 mmϕ).

Measurement of a Deposition Amount

Each sample was acidolyzed with sulfuric acid, nitric acid, or the like, and measured for a deposition amount of each metal by ICP (inductively coupled plasma) atomic emission spectroscopy. The acid to be specifically used depends on the composition of the each sample.

Determination of a Composition

The composition of each metal was calculated based on the measured deposition amount.

Determination of a Layer Structure

The layer structure of the obtained sample was determined by a depth profile by XPS (X-ray photoelectron spectroscopy) analysis. The analyzed elements are compositions of an A layer, a B layer, and a C layer, and C and O. These elements are made as designated elements. With the total of the designated elements being taken to be 100%, the concentration (at %) of the each element was analyzed. The thickness by the XPS (X-ray photoelectron spectroscopy) analysis corresponds to a distance (in terms of $SiO_2$) on the abscissa of the chart by the analysis.

The surface of the obtained sample was also subjected to a qualitative analysis by a survey measurement by XPS (X-ray photoelectron spectroscopy) analysis. The resolution of the concentration by the qualitative analysis was set at 0.1 at %.

An XPS apparatus to be used was 5600MC, made by Ulvac-Phi, Inc., and the measurement was carried out under the conditions of ultimate vacuum: $5.7\times10^{-9}$ Torr, exciting source: monochromated AlKα, output: 210 W, detection area: 800 μmϕ, incident angle: 45°, takeoff angle: 45°, and no neutralizing gun, and under the following sputtering condition.

Ion species: $Ar^+$

Acceleration voltage: 3 kV

Sweep region: 3 mm×3 mm

Rate: 2.8 nm/min (in terms of $SiO_2$)

Evaluations

Each sample was evaluated for the following items.

A. Inserting Force

The inserting force was evaluated by measuring an inserting force when a press-fit terminal was inserted into a substrate. A measurement apparatus used in the test was 1311NR, made by Aikoh Engineering Co., Ltd. The press-fit terminal was slid for the test in a state where the substrate was fixed. The number of the samples was set to be five; and a value obtained by averaging the values of the maximum inserting forces of the samples was employed as the inserting force. Samples of Comparative Example 1 were employed as a blank material for the inserting force.

The target of the inserting force was lower than 85% of the maximum inserting force of Comparative Example 1. Because Comparative Example 4 having an inserting force of 90% of the maximum inserting force of Comparative Example 1 was present as an actual product, the inserting force lower than 85% of the maximum inserting force of Comparative Example 1 and lower than that in Comparative Example 4 by 5% or more was targeted.

B. Whisker

The press-fit terminal was inserted into the through-hole of the substrate by a hand press, and a thermal shock cycle test (JEITA ET-7410) was carried out. The sample whose test had been finished was observed at a magnification of 100 to 10,000 times by a SEM (made by JEOL Ltd., type: JSM-5410) to observe the generation situation of whiskers.

Thermal Shock Cycle Test

Low temperature−40° C.×30 minutes⇆high temperature 85° C.×30 minutes/cycle×1000 cycles The target property was that no whiskers of 20 μm or longer in length were generated, but the top target was that no whisker at all was generated.

C. Contact Resistance

The contact resistance was measured using a contact simulator CRS-113-Au, made by Yamasaki-Seiki Co., Ltd., by a four-terminal method under the condition of a contact load of 50 g. The number of the samples was made to be five, and a range of from the minimum value to the maximum value of the samples was employed. The target property was a contact resistance of 10 mΩ or lower. The contact resistance was classified into 1 to 3 mΩ, 3 to 5 mΩ, and higher than 5 mΩ.

D. Heat Resistance

The heat resistance was evaluated by measuring the contact resistance of a sample after an atmospheric heating (175° C.×500 h) test. The target property was a contact resistance of 10 mΩ or lower, but the top target was made to be no variation (being equal) in the contact resistance before and after the heat resistance test. The heat resistance was classified into 1 to 4 mΩ, 2 to 4 mΩ, 2 to 5 mΩ, 3 to 6 mΩ, 3 to 7 mΩ, 6 to 9 mΩ, and higher than 10 mΩ in terms of contact resistance.

E. Gas Corrosion Resistance

The gas corrosion resistance was evaluated by three test environments shown in (1) to (3) described below. The evaluation of the gas corrosion resistance was carried out by using the contact resistance of a sample after the environment tests of (1) to (3). The target property was a contact resistance of 10 mΩ or lower, but the top target was made to be no variation (being equal) in the contact resistance before and after the gas corrosion resistance test. The gas corrosion resistance was classified into 1 to 3 mΩ, 1 to 4 mΩ, 2 to 4 mΩ, 2 to 6 mΩ, 3 to 5 mΩ, 3 to 7 mΩ, 4 to 7 mΩ, 5 to 8 mΩ, 6 to 9 mΩ, and higher than 10 mΩ in terms of contact resistance.

(1) Salt spray test

Salt concentration: 5%

Temperature: 35° C.

Spray pressure: 98±10 kPa

Exposure time: 96 h (2) Sulfurous acid gas corrosion test

Sulfurous acid concentration: 25 ppm

Temperature: 40° C.

Humidity: 80% RH

Exposure time: 96 h (3) Hydrogen sulfide gas corrosion test

Sulfurous acid concentration: 10 ppm

Temperature: 40° C.

Humidity: 80% RH

Exposure time: 96 h

G. Bending workability

The bending workability was evaluated by a 90° bending of a sample under the condition that the ratio of the thickness and the bending radius of the sample became 1 by using a letter-W-shape die. The evaluation was made as good in the case where no crack was observed in the observation of the surface of the bending-worked portion by an optical microscope, posing no practical problem; and as poor in the case where any cracks were observed therein.

H. Vickers Hardness

The Vickers hardnesses of an A layer and a C layer were measured by making an impression by a load of 980.7 mN (Hv0.1) from the surface of the A layer and the cross-section of the C layer in a load retention time of 15 sec.

I. Indentation Hardness

The indentation hardnesses of an A layer and a C layer were measured by making an impression on the surface of the A layer and the cross-section of the C layer at a load of 0.1 mN by an ultrafine hardness tester (ENT-2100, made by Elionix Inc.).

J. Surface Roughness

The surface roughnesses (arithmetic average height (Ra) and maximum height (Rz)) were measured according to JIS B 0601 by using a non-contact type three dimensional measurement instrument (made by Mitaka Kohki Co., Ltd., type: NH-3). The measurement was carried out five times per sample, with a cutoff of 0.25 mm and a measurement length of 1.50 mm.

K. Reflection Density

The reflection density was measured using a densitometer (ND-1, made by Nippon Denshoku Industries Co., Ltd.).

L. Generation of Powder

The press-fit terminal inserted into the through-hole was extracted from the through-hole, and the cross-section of the press-fit terminal was observed at a magnification of 100 to 10,000 times by a SEM (made by JEOL Ltd., type: JSM-5410) to observe the generation status of powder. The press-fit terminal with which the diameter of the powder was smaller than 5 μm was made as good; the press-fit terminal with which the diameter of the powder was 5 to smaller than 10 μm was made as average; and the press-fit terminal with which the diameter of the powder was 10 μm or larger was made as poor.

The respective conditions and evaluation results are shown in Tables 8 to 22.

TABLE 8

| | | A Layer | | | B Layer | | | C Layer | | | |
|---|---|---|---|---|---|---|---|---|---|---|---|
| | | Composition | Thickness [μm] | Deposition Amount [μg/cm$^2$] | Composition | Thickness [μm] | Deposition Amount [μg/cm$^2$] | Composition | Thickness [μm] | Deposition Amount [mg/cm$^2$] | Heat Treatment Condition |
| Example | 1 | Sn | 0.2 | 146 | Ag | 0.3 | 315 | Ni | 1.0 | 0.9 | None |
| | 2 | Sn | 0.2 | 146 | Ag | 0.001 | 1 | Ni | 1.0 | 0.9 | None |
| | 3 | Sn | 0.03 | 22 | Ag | 0.03 | 32 | Ni | 1.0 | 0.9 | None |
| | 4 | Sn | 0.002 | 1 | Ag | 0.3 | 315 | Ni | 1.0 | 0.9 | None |
| | 5 | Sn | 0.002 | 1 | Ag | 0.001 | 1 | Ni | 1.0 | 0.9 | None |
| | 6 | In | 0.03 | 22 | Ag | 0.03 | 32 | Ni | 1.0 | 0.9 | None |
| | 7 | Sn—2Ag | 0.03 | 22 | Ag | 0.03 | 32 | Ni | 1.0 | 0.9 | None |
| | 8 | Sn—2As | 0.03 | 22 | Ag | 0.03 | 32 | Ni | 1.0 | 0.9 | None |
| | 9 | Sn—2Au | 0.03 | 22 | Ag | 0.03 | 32 | Ni | 1.0 | 0.9 | None |
| | 10 | Sn—2Bi | 0.03 | 22 | Ag | 0.03 | 32 | Ni | 1.0 | 0.9 | None |
| | 11 | Sn—2Cd | 0.03 | 22 | Ag | 0.03 | 32 | Ni | 1.0 | 0.9 | None |
| | 12 | Sn—2Co | 0.03 | 22 | Ag | 0.03 | 32 | Ni | 1.0 | 0.9 | None |
| | 13 | Sn—2Cr | 0.03 | 22 | Ag | 0.03 | 32 | Ni | 1.0 | 0.9 | None |
| | 14 | Sn—2Cu | 0.03 | 22 | Ag | 0.03 | 32 | Ni | 1.0 | 0.9 | None |
| | 15 | Sn—2Fe | 0.03 | 22 | Ag | 0.03 | 32 | Ni | 1.0 | 0.9 | None |
| | 16 | Sn—2In | 0.03 | 22 | Ag | 0.03 | 32 | Ni | 1.0 | 0.9 | None |
| | 17 | Sn—2Mn | 0.03 | 22 | Ag | 0.03 | 32 | Ni | 1.0 | 0.9 | None |
| | 18 | Sn—2Mo | 0.03 | 22 | Ag | 0.03 | 32 | Ni | 1.0 | 0.9 | None |
| | 19 | Sn—2Ni | 0.03 | 22 | Ag | 0.03 | 32 | Ni | 1.0 | 0.9 | None |
| | 20 | Sn—2Pb | 0.03 | 22 | Ag | 0.03 | 32 | Ni | 1.0 | 0.9 | None |
| | 21 | Sn—2Sb | 0.03 | 22 | Ag | 0.03 | 32 | Ni | 1.0 | 0.9 | None |
| | 22 | Sn—2W | 0.03 | 22 | Ag | 0.03 | 32 | Ni | 1.0 | 0.9 | None |
| | 23 | Sn—2Zn | 0.03 | 22 | Ag | 0.03 | 32 | Ni | 1.0 | 0.9 | None |
| | 24 | Sn | 0.03 | 22 | Au | 0.03 | 32 | Ni | 1.0 | 0.9 | None |
| | 25 | Sn | 0.03 | 22 | Pt | 0.03 | 32 | Ni | 1.0 | 0.9 | None |
| | 26 | Sn | 0.03 | 22 | Pd | 0.03 | 32 | Ni | 1.0 | 0.9 | None |
| | 27 | Sn | 0.03 | 22 | Ru | 0.03 | 32 | Ni | 1.0 | 0.9 | None |
| | 28 | Sn | 0.03 | 22 | Rh | 0.03 | 32 | Ni | 1.0 | 0.9 | None |
| | 29 | Sn | 0.03 | 22 | Os | 0.03 | 32 | Ni | 1.0 | 0.9 | None |
| | 30 | Sn | 0.03 | 22 | Ir | 0.03 | 32 | Ni | 1.0 | 0.9 | None |
| | 31 | Sn | 0.03 | 22 | Ag—2Au | 0.03 | 32 | Ni | 1.0 | 0.9 | None |
| | 32 | Sn | 0.03 | 22 | Ag—2Bi | 0.03 | 32 | Ni | 1.0 | 0.9 | None |
| | 33 | Sn | 0.03 | 22 | Ag—2Cd | 0.03 | 32 | Ni | 1.0 | 0.9 | None |
| | 34 | Sn | 0.03 | 22 | Ag—2Co | 0.03 | 32 | Ni | 1.0 | 0.9 | None |
| | 35 | Sn | 0.03 | 22 | Ag—2Cu | 0.03 | 32 | Ni | 1.0 | 0.9 | None |
| | 36 | Sn | 0.03 | 22 | Ag—2Fe | 0.03 | 32 | Ni | 1.0 | 0.9 | None |
| | 37 | Sn | 0.03 | 22 | Ag—2In | 0.03 | 32 | Ni | 1.0 | 0.9 | None |
| | 38 | Sn | 0.03 | 22 | Ag—2Ir | 0.03 | 32 | Ni | 1.0 | 0.9 | None |
| | 39 | Sn | 0.03 | 22 | Ag—2Mn | 0.03 | 32 | Ni | 1.0 | 0.9 | None |
| Target | | | 0.002≤ ≤0.2 | 1≤ ≤150 | | 0.001≤ ≤0.3 | 1≤ ≤330 | | 0.005≤ | 0.03≤ | |

TABLE 9

| | | A Layer | | | B Layer | | | C Layer | | | |
|---|---|---|---|---|---|---|---|---|---|---|---|
| | | Composition | Thickness [μm] | Deposition Amount [μg/cm$^2$] | Composition | Thickness [μm] | Deposition Amount [μg/cm$^2$] | Composition | Thickness [μm] | Deposition Amount [mg/cm$^2$] | Heat Treatment Condition |
| Example | 40 | Sn | 0.03 | 22 | Ag—2Mo | 0.03 | 32 | Ni | 1.0 | 0.9 | None |
| | 41 | Sn | 0.03 | 22 | Ag—2Ni | 0.03 | 32 | Ni | 1.0 | 0.9 | None |
| | 42 | Sn | 0.03 | 22 | Ag—2Pb | 0.03 | 32 | Ni | 1.0 | 0.9 | None |

TABLE 9-continued

| | | A Layer | | | B Layer | | | C Layer | | | |
|---|---|---|---|---|---|---|---|---|---|---|---|
| | | Composition | Thickness [μm] | Deposition Amount [μg/cm$^2$] | Composition | Thickness [μm] | Deposition Amount [μg/cm$^2$] | Composition | Thickness [μm] | Deposition Amount [mg/cm$^2$] | Heat Treatment Condition |
| | 43 | Sn | 0.03 | 22 | Ag—2Pd | 0.03 | 32 | Ni | 1.0 | 0.9 | None |
| | 44 | Sn | 0.03 | 22 | Ag—2Pt | 0.03 | 32 | Ni | 1.0 | 0.9 | None |
| | 45 | Sn | 0.03 | 22 | Ag—2Rh | 0.03 | 32 | Ni | 1.0 | 0.9 | None |
| | 46 | Sn | 0.03 | 22 | Ag—2Ru | 0.03 | 32 | Ni | 1.0 | 0.9 | None |
| | 47 | Sn | 0.03 | 22 | Ag—2Sb | 0.03 | 32 | Ni | 1.0 | 0.9 | None |
| | 48 | Sn | 0.03 | 22 | Ag—2Se | 0.03 | 32 | Ni | 1.0 | 0.9 | None |
| | 49 | Sn | 0.03 | 22 | Ag—2Sn | 0.03 | 32 | Ni | 1.0 | 0.9 | None |
| | 50 | Sn | 0.03 | 22 | Ag—2W | 0.03 | 32 | Ni | 1.0 | 0.9 | None |
| | 51 | Sn | 0.03 | 22 | Ag—2TI | 0.03 | 32 | Ni | 1.0 | 0.9 | None |
| | 52 | Sn | 0.03 | 22 | Ag—2Zn | 0.03 | 32 | Ni | 1.0 | 0.9 | None |
| Com-parative Example | 1 | Sn | 1.0 | 728 | | | | Ni | 0.5 | 0.4 | 300° C. × 5 sec. |
| | 2 | Sn | 0.6 | 437 | | | | Ni | 0.5 | 0.4 | 300° C. × 5 sec. |
| | 3 | Sn | 0.6 | 437 | | | | Ni | 0.5 | 0.4 | |
| | 4 | Sn | 0.6 | 437 | Cu | 0.3 | | Ni | 0.5 | 0.4 | 300° C. × 5 sec. |
| | 5 | Sn | 0.4 | 291 | Cu | 0.3 | | Ni | 0.5 | 0.4 | 300° C. × 5 sec. |
| | 6 | Sn | 0.4 | 291 | Cu | 0.3 | | Ni | 0.5 | 0.4 | |
| | 7 | Sn | 1.0 | 728 | | | | Cu | 0.5 | 0.4 | 300° C. × 5 sec. |
| | 8 | Sn | 1.0 | 728 | | | | Ni | 1.0 | 0.9 | 300° C. × 5 sec. |
| | 9 | Sn | 0.3 | 218 | Ag | 0.3 | 315 | Ni | 1.0 | 0.9 | None |
| | 10 | Sn | 0.3 | 218 | Ag | 0.001 | 1.1 | Ni | 1.0 | 0.9 | None |
| | 11 | Sn | 0.2 | 146 | Ag | 0.5 | 525 | Ni | 1.0 | 0.9 | None |
| | 12 | Sn | 0.2 | 146 | Ag | | | Ni | 1.0 | 0.9 | None |
| | 13 | Sn | 0.002 | 1.5 | Ag | 0.5 | 525 | Ni | 1.0 | 0.9 | None |
| | 14 | Sn | 0.002 | 1.5 | Ag | | | Ni | 1.0 | 0.9 | None |
| | 15 | Sn | 0.001 | 0.7 | Ag | 0.3 | 315 | Ni | 1.0 | 0.9 | None |
| | 16 | Sn | 0.001 | 0.7 | Ag | 0.001 | 1.1 | Ni | 1.0 | 0.9 | None |
| | 17 | Ag | 0.03 | 32 | Sn | 0.03 | 22 | Ni | 1.0 | 0.9 | None |
| Target | | | 0.002≤ ≤0.2 | 1≤ ≤150 | | 0.001≤ ≤0.3 | 1≤ ≤330 | | 0.005≤ | 0.03≤ | |

TABLE 10

| | | Whisker | | | | | Gas Corrosion Resistance | | | |
|---|---|---|---|---|---|---|---|---|---|---|
| | | Number of Whisker of Shorter Than 20 μm in Length [Number] | Number of Whiskers of 20 μm or Longer in Length [Number] | Inserting Force Maximum Inserting Force/Maximum Inserting Force of Comparative Example 1 [%] | Contact Resistance [mΩ] | Heat Resistance Contact Resistance [mΩ] | Salt Spray Contact Resistance [mΩ] | Sulfurous Acid Gas Contact Resistance [mΩ] | Hydrogen Sulfide Contact Resistance [mΩ] | Generation Situation of Powder |
| Example | 1 | 0 | 0 | 82 | 1-3 | 1-4 | 1-4 | 1-4 | 1-4 | Average |
| | 2 | 0 | 0 | 79 | 1-3 | 6-9 | 1-4 | 1-4 | 1-4 | Average |
| | 3 | 0 | 0 | 77 | 1-3 | 1-4 | 1-4 | 1-4 | 1-4 | Good |
| | 4 | 0 | 0 | 79 | 1-3 | 1-4 | 4-7 | 5-8 | 6-9 | Average |
| | 5 | 0 | 0 | 76 | 1-3 | 6-9 | 4-7 | 5-8 | 6-9 | Good |
| | 6 | 0 | 0 | 77 | 1-3 | 1-4 | 1-4 | 1-4 | 1-4 | Good |
| | 7 | 0 | 0 | 77 | 1-3 | 1-4 | 1-4 | 1-4 | 1-4 | Good |
| | 8 | 0 | 0 | 77 | 1-3 | 1-4 | 1-4 | 1-4 | 1-4 | Good |
| | 9 | 0 | 0 | 77 | 1-3 | 1-4 | 1-4 | 1-4 | 1-4 | Good |
| | 10 | 0 | 0 | 77 | 1-3 | 1-4 | 1-4 | 1-4 | 1-4 | Good |
| | 11 | 0 | 0 | 77 | 1-3 | 1-4 | 1-4 | 1-4 | 1-4 | Good |
| | 12 | 0 | 0 | 77 | 1-3 | 1-4 | 1-4 | 1-4 | 1-4 | Good |
| | 13 | 0 | 0 | 77 | 1-3 | 1-4 | 1-4 | 1-4 | 1-4 | Good |
| | 14 | 0 | 0 | 77 | 1-3 | 1-4 | 1-4 | 1-4 | 1-4 | Good |
| | 15 | 0 | 0 | 77 | 1-3 | 1-4 | 1-4 | 1-4 | 1-4 | Good |
| | 16 | 0 | 0 | 77 | 1-3 | 1-4 | 1-4 | 1-4 | 1-4 | Good |
| | 17 | 0 | 0 | 77 | 1-3 | 1-4 | 1-4 | 1-4 | 1-4 | Good |
| | 18 | 0 | 0 | 77 | 1-3 | 1-4 | 1-4 | 1-4 | 1-4 | Good |
| | 19 | 0 | 0 | 77 | 1-3 | 1-4 | 1-4 | 1-4 | 1-4 | Good |
| | 20 | 0 | 0 | 77 | 1-3 | 1-4 | 1-4 | 1-4 | 1-4 | Good |
| | 21 | 0 | 0 | 77 | 1-3 | 1-4 | 1-4 | 1-4 | 1-4 | Good |
| | 22 | 0 | 0 | 77 | 1-3 | 1-4 | 1-4 | 1-4 | 1-4 | Good |
| | 23 | 0 | 0 | 77 | 1-3 | 1-4 | 1-4 | 1-4 | 1-4 | Good |
| | 24 | 0 | 0 | 77 | 1-3 | 1-4 | 1-4 | 1-4 | 1-4 | Good |
| | 25 | 0 | 0 | 77 | 1-3 | 1-4 | 1-4 | 1-4 | 1-4 | Good |
| | 26 | 0 | 0 | 77 | 1-3 | 1-4 | 1-4 | 1-4 | 1-4 | Good |

TABLE 10-continued

| | Whisker | | | | | Gas Corrosion Resistance | | | |
|---|---|---|---|---|---|---|---|---|---|
| | Number of Whisker of Shorter Than 20 μm in Length [Number] | Number of Whiskers of 20 μm or Longer in Length [Number] | Inserting Force Maximum Inserting Force/Maximum Inserting Force of Comparative Example 1 [%] | Contact Resistance [mΩ] | Heat Resistance Contact Resistance [mΩ] | Salt Spray Contact Resistance [mΩ] | Sulfurous Acid Gas Contact Resistance [mΩ] | Hydrogen Sulfide Contact Resistance [mΩ] | Generation Situation of Powder |
| 27 | 0 | 0 | 77 | 1-3 | 1-4 | 1-4 | 1-4 | 1-4 | Good |
| 28 | 0 | 0 | 77 | 1-3 | 1-4 | 1-4 | 1-4 | 1-4 | Good |
| 29 | 0 | 0 | 77 | 1-3 | 1-4 | 1-4 | 1-4 | 1-4 | Good |
| 30 | 0 | 0 | 77 | 1-3 | 1-4 | 1-4 | 1-4 | 1-4 | Good |
| 31 | 0 | 0 | 77 | 1-3 | 1-4 | 1-4 | 1-4 | 1-4 | Good |
| 32 | 0 | 0 | 77 | 1-3 | 1-4 | 1-4 | 1-4 | 1-4 | Good |
| 33 | 0 | 0 | 77 | 1-3 | 1-4 | 1-4 | 1-4 | 1-4 | Good |
| 34 | 0 | 0 | 77 | 1-3 | 1-4 | 1-4 | 1-4 | 1-4 | Good |
| 35 | 0 | 0 | 77 | 1-3 | 1-4 | 1-4 | 1-4 | 1-4 | Good |
| 36 | 0 | 0 | 77 | 1-3 | 1-4 | 1-4 | 1-4 | 1-4 | Good |
| 37 | 0 | 0 | 77 | 1-3 | 1-4 | 1-4 | 1-4 | 1-4 | Good |
| 38 | 0 | 0 | 77 | 1-3 | 1-4 | 1-4 | 1-4 | 1-4 | Good |
| 39 | 0 | 0 | 77 | 1-3 | 1-4 | 1-4 | 1-4 | 1-4 | Good |
| Target | | 0 | <85 | ≤10 | ≤10 | ≤10 | ≤10 | ≤10 | Average or higher |

TABLE 11

| | | Whisker | | | | | Gas Corrosion Resistance | | | |
|---|---|---|---|---|---|---|---|---|---|---|
| | | Number of Whiskers of Shorter Than 20 μm in Length [Number] | Number of Whiskers of 20 μm or Longer in Length [Number] | Inserting Force Maximum Inserting Force/Maximum Inserting Force of Comparative Example 1 [%] | Contact Resistance [mΩ] | Heat Resistance Contact Resistance [mΩ] | Salt Spray Contact Resistance [mΩ] | Sulfurous Acid Gas Contact Resistance [mΩ] | Hydrogen Sulfide Contact Resistance [mΩ] | Generation Situation of Powder |
| Example | 40 | 0 | 0 | 77 | 1-3 | 1-4 | 1-4 | 1-4 | 1-4 | Good |
| | 41 | 0 | 0 | 77 | 1-3 | 1-4 | 1-4 | 1-4 | 1-4 | Good |
| | 42 | 0 | 0 | 77 | 1-3 | 1-4 | 1-4 | 1-4 | 1-4 | Good |
| | 43 | 0 | 0 | 77 | 1-3 | 1-4 | 1-4 | 1-4 | 1-4 | Good |
| | 44 | 0 | 0 | 77 | 1-3 | 1-4 | 1-4 | 1-4 | 1-4 | Good |
| | 45 | 0 | 0 | 77 | 1-3 | 1-4 | 1-4 | 1-4 | 1-4 | Good |
| | 46 | 0 | 0 | 77 | 1-3 | 1-4 | 1-4 | 1-4 | 1-4 | Good |
| | 47 | 0 | 0 | 77 | 1-3 | 1-4 | 1-4 | 1-4 | 1-4 | Good |
| | 48 | 0 | 0 | 77 | 1-3 | 1-4 | 1-4 | 1-4 | 1-4 | Good |
| | 49 | 0 | 0 | 77 | 1-3 | 1-4 | 1-4 | 1-4 | 1-4 | Good |
| | 50 | 0 | 0 | 77 | 1-3 | 1-4 | 1-4 | 1-4 | 1-4 | Good |
| | 51 | 0 | 0 | 77 | 1-3 | 1-4 | 1-4 | 1-4 | 1-4 | Good |
| | 52 | 0 | 0 | 77 | 1-3 | 1-4 | 1-4 | 1-4 | 1-4 | Good |
| Comparative Example | 1 | — | ≤3 | — | 1-3 | 3-7 | 1-3 | 1-3 | 1-3 | Poor |
| | 2 | | ≤3 | | 1-3 | | | | | Poor |
| | 3 | | ≤3 | 120 | 1-3 | | | | | Poor |
| | 4 | | ≤3 | 90 | 1-3 | 3-7 | 1-3 | 1-3 | 1-3 | Poor |
| | 5 | | ≤2 | | 1-3 | | | | | Poor |
| | 6 | | ≤2 | 105 | 1-3 | | | | | Poor |
| | 7 | — | ≤3 | 100 | 1-3 | 3-7 | 1-3 | 1-3 | 1-3 | Poor |
| | 8 | — | ≤3 | 100 | 1-3 | 3-7 | 1-3 | 1-3 | 1-3 | Poor |
| | 9 | 1-5 | 0 | 84 | 1-3 | | | | | Poor |
| | 10 | 1-5 | 0 | 81 | 1-3 | | | | | Average |
| | 11 | | | | 1-3 | | | | | Poor |
| | 12 | | | | 1-3 | 10< | | | | Average |
| | 13 | | | | 1-3 | | | | | Poor |
| | 14 | | | | 1-3 | 10< | | | | Good |
| | 15 | | | | 1-3 | | | | 10< | Average |
| | 16 | | | | 1-3 | | | | 10< | Good |
| | 17 | | | | 1-3 | | | | 10< | Good |
| Target | | | 0 | <85 | ≤10 | ≤10 | ≤10 | ≤10 | ≤10 | Average or higher |

TABLE 12

| | | A Layer | | | B Layer | | | C Layer | | |
|---|---|---|---|---|---|---|---|---|---|---|
| | | Composition | Thickness [μm] | Deposition Amount [μg/cm$^2$] | Composition | Thickness [μm] | Deposition Amount [μg/cm$^2$] | Composition | Thickness [μm] | Deposition Amount [mg/cm$^2$] |
| Example | 53 | Sn | 0.03 | 22 | Ag | 0.03 | 32 | Cr | 1.0 | 0.9 |
| | 54 | Sn | 0.03 | 22 | Ag | 0.03 | 32 | Mn | 1.0 | 0.9 |
| | 55 | Sn | 0.03 | 22 | Ag | 0.03 | 32 | Fe | 1.0 | 0.9 |
| | 56 | Sn | 0.03 | 22 | Ag | 0.03 | 32 | Co | 1.0 | 0.9 |
| | 57 | Sn | 0.03 | 22 | Ag | 0.03 | 32 | Cu | 1.0 | 0.9 |
| | 58 | Sn | 0.03 | 22 | Ag | 0.03 | 32 | Ni—Cr | 1.0 | 0.9 |
| | 59 | Sn | 0.03 | 22 | Ag | 0.03 | 32 | Ni—Mn | 1.0 | 0.9 |
| | 60 | Sn | 0.03 | 22 | Ag | 0.03 | 32 | Ni—Fe | 1.0 | 0.9 |
| | 61 | Sn | 0.03 | 22 | Ag | 0.03 | 32 | Ni—Co | 1.0 | 0.9 |
| | 62 | Sn | 0.03 | 22 | Ag | 0.03 | 32 | Ni—Cu | 1.0 | 0.9 |
| | 63 | Sn | 0.03 | 22 | Ag | 0.03 | 32 | Ni—B | 1.0 | 0.9 |
| | 64 | Sn | 0.03 | 22 | Ag | 0.03 | 32 | Ni—P | 1.0 | 0.9 |
| | 65 | Sn | 0.03 | 22 | Ag | 0.03 | 32 | Ni—Sn | 1.0 | 0.9 |
| | 66 | Sn | 0.03 | 22 | Ag | 0.03 | 32 | Ni—Zn | 1.0 | 0.9 |
| | 67 | Sn | 0.03 | 22 | Ag | 0.03 | 32 | Ni | 0.1 | 0.1 |
| Comparative Example | 18 | Sn | 0.03 | 22 | Ag | 0.03 | 32 | Ni | 0.01 | 0.01 |
| Target | | | 0.002≤ ≤0.2 | 1≤ ≤150 | | 0.001≤ ≤0.3 | 1≤ ≤330 | | 0.005≤ | 0.03≤ |

| | | Heat Treatment Condition | Inserting Force Maximum Inserting Force/Maximum Inserting Force of Comparative Example 1 [%] | Contact Resistance [mΩ] | Gas Corrosion Resistance: Heat Resistance Contact Resistance [mΩ] | Salt Spray Contact Resistance [mΩ] | Sulfurous Acid Gas Contact Resistance [mΩ] | Hydrogen Sulfide Contact Resistance [mΩ] | Generation Situation of Powder |
|---|---|---|---|---|---|---|---|---|---|
| Example | 53 | None | 66 | 1-3 | 1-4 | 1-4 | 1-4 | 1-4 | Good |
| | 54 | None | 80 | 1-3 | 1-4 | 1-4 | 1-4 | 1-4 | Good |
| | 55 | None | 77 | 1-3 | 1-4 | 1-4 | 1-4 | 1-4 | Good |
| | 56 | None | 75 | 1-3 | 1-4 | 1-4 | 1-4 | 1-4 | Good |
| | 57 | None | 79 | 1-3 | 1-4 | 1-4 | 1-4 | 1-4 | Good |
| | 58 | None | 71 | 1-3 | 1-4 | 1-4 | 1-4 | 1-4 | Good |
| | 59 | None | 79 | 1-3 | 1-4 | 1-4 | 1-4 | 1-4 | Good |
| | 60 | None | 77 | 1-3 | 1-4 | 1-4 | 1-4 | 1-4 | Good |
| | 61 | None | 73 | 1-3 | 1-4 | 1-4 | 1-4 | 1-4 | Good |
| | 62 | None | 77 | 1-3 | 1-4 | 1-4 | 1-4 | 1-4 | Good |
| | 63 | None | 66 | 1-3 | 1-4 | 1-4 | 1-4 | 1-4 | Good |
| | 64 | None | 66 | 1-3 | 1-4 | 1-4 | 1-4 | 1-4 | Good |
| | 65 | None | 75 | 1-3 | 1-4 | 1-4 | 1-4 | 1-4 | Good |
| | 66 | None | 77 | 1-3 | 1-4 | 1-4 | 1-4 | 1-4 | Good |
| | 67 | None | 80 | 1-3 | 1-4 | 1-4 | 1-4 | 1-4 | Good |
| Comparative Example | 18 | None | 89 | 1-3 | 10< | 2-4 | 2-4 | 2-4 | — |
| Target | | | <85 | ≤10 | ≤10 | ≤10 | ≤10 | ≤10 | Average or higher |

TABLE 13

| | | A Layer | | | B Layer | | | |
|---|---|---|---|---|---|---|---|---|
| | | Composition | Thickness [μm] | Deposition Amount [μg/cm$^2$] | Composition | Thickness [μm] | Deposition Amount [μg/cm$^2$] | C Layer Composition |
| Example | 1 | Sn | 0.2 | 146 | Ag | 0.3 | 315 | Ni |
| | 68 | Sn | 0.2 | 146 | Ag | 0.3 | 315 | Ni (semi-bright) |
| | 69 | Sn | 0.2 | 146 | Ag | 0.3 | 315 | Ni (bright) |
| | 64 | Sn | 0.2 | 146 | Ag | 0.3 | 315 | Ni—P |
| Target | | | 0.002≤ ≤0.2 | 1≤ ≤150 | | 0.001≤ ≤0.3 | 1≤ ≤330 | |

TABLE 13-continued

| | | C Layer | | | | | Inserting Force Maximum Inserting Force/ Maximum Inserting Force of | |
|---|---|---|---|---|---|---|---|---|
| | | Thickness [μm] | Deposition Amount [mg/cm$^2$] | Heat Treatment Condition | Vickers Hardness Hv | Indentation Hardness [MPa] | Comparative Example 1 [%] | Bending Workability |
| Example | 1 | 1.0 | 0.9 | None | 130 | 1500 | 82 | Good |
| | 68 | 1.0 | 0.9 | None | 300 | 3400 | 78 | Good |
| | 69 | 1.0 | 0.9 | None | 600 | 6700 | 72 | Good |
| | 64 | 1.0 | 0.9 | None | 1200 | 13000 | 66 | Poor |
| Target | | 0.005≤ | 0.03≤ | | | | <85 | |

TABLE 14

| | | A Layer | | | B Layer | | | C Layer | | |
|---|---|---|---|---|---|---|---|---|---|---|
| | | Composition | Thickness [μm] | Deposition Amount [μg/cm$^2$] | Composition | Thickness [μm] | Deposition Amount [μg/cm$^2$] | Composition | Thickness [μm] | Deposition Amount [mg/cm$^2$] |
| Example | 1 | Sn | 0.2 (Dk = 0.5) | 146 | Ag | 0.3 (Dk = 0.5) | 315 | Ni | 1.0 | 0.9 |
| | 70 | Sn | 0.2 (Dk = 0.5) | 146 | Ag | 0.3 (Dk = 4) | 315 | Ni | 1.0 | 0.9 |
| | 71 | Sn | 0.2 (Dk = 4) | 146 | Ag | 0.3 (Dk = 0.5) | 315 | Ni | 1.0 | 0.9 |
| | 72 | Sn | 0.2 (Dk = 4) | 146 | Ag | 0.3 (Dk = 45) | 315 | Ni | 1.0 | 0.9 |
| Target | | | 0.002≤ ≤0.2 | 1≤ ≤150 | | 0.001≤ ≤0.3 | 1≤ ≤330 | | 0.005≤ | 0.03≤ |

| | | | Evaluation from Outermost Surface Layer | | | | Gas Corrosion Resistance | | | |
|---|---|---|---|---|---|---|---|---|---|---|
| | | Heat Treatment Condition | Arithmetic Average Height Ra [μm] | Maximum Height Rz [μm] | Reflection Density | Contact Resistance [mΩ] | Heat Resistance Contact Resistance [mΩ] | Salt Spray Contact Resistance [mΩ] | Sulfurous Acid Gas Contact Resistance [mΩ] | Hydrogen Sulfide Contact Resistance [mΩ] |
| Example | 1 | None | 0.12 | 1.25 | 0.2 | 1-3 | 2-4 | 2-4 | 2-4 | 2-4 |
| | 70 | None | 0.087 | 0.75 | 0.3 | 1-3 | 2-4 | 1-3 | 1-3 | 1-3 |
| | 71 | None | 0.075 | 0.55 | 0.7 | 1-3 | 2-4 | 1-3 | 1-3 | 1-3 |
| | 72 | None | 0.045 | 0.35 | 0.9 | 1-3 | 2-4 | 1-3 | 1-3 | 1-3 |
| Target | | | | | | ≤10 | ≤10 | ≤10 | ≤10 | ≤10 |

TABLE 15

| | | A Layer | | | B Layer | | | C Layer | | | |
|---|---|---|---|---|---|---|---|---|---|---|---|
| | | Composition | Thickness [μm] | Deposition Amount [μg/cm$^2$] | Composition | Thickness [μm] | Deposition Amount [μg/cm$^2$] | Composition | Thickness [μm] | Deposition Amount [mg/cm$^2$] | Heat Treatment Condition |
| Example | 3 | Sn | 0.03 | 22 | Ag | 0.03 | 32 | Ni | 1.0 | 0.9 | None |
| | 67 | Sn | 0.03 | 22 | Ag | 0.03 | 32 | Ni | 0.1 | 0.1 | None |
| Comparative | 18 | Sn | 0.03 | 22 | Ag | 0.03 | 32 | Ni | 0.01 | 0.01 | None |
| Example | 17 | Ag | 0.03 | 22 | Sn | 0.03 | 32 | Ni | 1.0 | 0.89 | None |
| | 14 | Sn | 0.002 | 1.5 | | | | Ni | 1.0 | 0.89 | None |
| | 16 | Sn | 0.001 | 0.7 | Ag | 0.001 | 1.1 | Ni | 1.0 | 0.89 | None |
| Target | | | 0.002≤ ≤0.2 | 1≤ ≤150 | | 0.001≤ ≤0.3 | 1≤ ≤330 | | 0.005≤ | 0.03≤ | |

TABLE 15-continued

| | | XPS (Depth) | | | | Inserting Force Maximum Inserting Force/Maximum | | | Gas Corrosion Resistance | | |
|---|---|---|---|---|---|---|---|---|---|---|---|
| | | Order of $D_1$, $D_2$, and $D_3$ | $D_1$ [at %] | $D_2$ [at %] | $D_3$ Thickness of 25% or More [nm] | Inserting Force of Comparative Example 1 [%] | Contact Resistance [mΩ] | Heat Resistance Contact Resistance [mΩ] | Salt Spray Contact Resistance [mΩ] | Sulfurous Acid Gas Contact Resistance [mΩ] | Hydrogen Sulfide Contact Resistance [mΩ] |
| Example | 3 | $D_1 \Rightarrow D_2 \Rightarrow D_3$ | 35 | 35 | 100< | 77 | 1-3 | 1-4 | 1-4 | 1-4 | 1-4 |
| | 67 | $D_1 \Rightarrow D_2 \Rightarrow D_3$ | 87 | 87 | 80 | 80 | 1-3 | 1-4 | 1-4 | 1-4 | 1-4 |
| Comparative | 18 | $D_1 \Rightarrow D_2 \Rightarrow D_3$ | 87 | 87 | 25 | 89 | 1-3 | <10 | 2-4 | 2-4 | 2-4 |
| Example | 17 | $D_2 \Rightarrow D_1 \Rightarrow D_3$ | | | | | 1-3 | | | | <10 |
| | 14 | $D_1 \Rightarrow D_3$ | 12 | <10 | 100< | | 1-3 | <10 | | | |
| | 16 | $D_1 \Rightarrow D_2 \Rightarrow D_3$ | <10 | 14 | 100< | | 1-3 | | | | <10 |
| Target | | | | | | <85 | ≤10 | ≤10 | ≤10 | ≤10 | ≤10 |

TABLE 16

| | | A Layer | | | B Layer | | | C Layer | | | |
|---|---|---|---|---|---|---|---|---|---|---|---|
| | | Composition | Thickness [μm] | Deposition Amount [μg/cm²] | Composition | Thickness [μm] | Deposition Amount [μg/cm²] | Composition | Thickness [μm] | Deposition Amount [mg/cm²] | Heat Treatment Condition |
| Example | 3 | Sn | 0.03 | 22 | Ag | 0.03 | 32 | Ni | 1.0 | 0.9 | None |
| | 73 | Sn | 0.01 | 7 | Ag | 0.03 | 32 | Ni | 1.0 | 0.9 | None |
| | 74 | Sn | 0.005 | 4 | Ag | 0.03 | 32 | Ni | 1.0 | 0.9 | None |
| | 75 | Sn | 0.1 | 73 | Ag | 0.03 | 32 | Ni | 1.0 | 0.9 | None |
| | 76 | Sn | 0.2 | 146 | Ag | 0.03 | 32 | Ni | 1.0 | 0.9 | None |
| Target | | | 0.002≤ ≤0.2 | 1≤ ≤150 | | 0.001≤ ≤0.3 | 1≤ ≤330 | | 0.005≤ | 0.03≤ | |

| | | Whisker | | | | | Gas Corrosion Resistance | | | |
|---|---|---|---|---|---|---|---|---|---|---|
| | | Number of Whiskers of Shorter Than 20 μm in Length [Number] | Number of Whiskers of 20 μm or Longer in Length [Number] | Inserting Force Maximum Inserting Force/Maximum Inserting Force of Comparative Example 1 [%] | Contact Resistance [mΩ] | Heat Resistance Contact Resistance [mΩ] | Salt Spray Contact Resistance [mΩ] | Sulfurous Acid Gas Contact Resistance [mΩ] | Hydrogen Sulfide Contact Resistance [mΩ] | Generation Situation of Powder |
| Example | 3 | 0 | 0 | 77 | 1-3 | 1-4 | 1-4 | 1-4 | 1-4 | Good |
| | 73 | 0 | 0 | 75 | 1-3 | 1-4 | 1-4 | 1-4 | 1-4 | Good |
| | 74 | 0 | 0 | 74 | 1-3 | 1-4 | 2-6 | 3-7 | 4-7 | Good |
| | 75 | 0 | 0 | 79 | 1-3 | 1-4 | 1-4 | 1-4 | 1-4 | Good |
| | 76 | 0 | 0 | 83 | 1-3 | 1-4 | 1-4 | 1-4 | 1-4 | Average |
| Target | | | 0 | <85 | ≤10 | ≤10 | ≤10 | ≤10 | ≤10 | Average or higher |

TABLE 17

| | | A Layer | | | B Layer | | | C Layer | | |
|---|---|---|---|---|---|---|---|---|---|---|
| | | Composition | Thickness [μm] | Deposition Amount [μg/cm²] | Composition | Thickness [μm] | Deposition Amount [μg/cm²] | Composition | Thickness [μm] | Deposition Amount [mg/cm²] |
| Example | 3 | Sn | 0.03 | 22 | Ag | 0.03 | 32 | Ni | 1.0 | 0.9 |
| | 77 | Sn | 0.03 | 22 | Ag | 0.001 | 1.1 | Ni | 1.0 | 0.89 |
| | 78 | Sn | 0.03 | 22 | Ag | 0.007 | 7.4 | Ni | 1.0 | 0.89 |
| | 79 | Sn | 0.03 | 22 | Ag | 0.1 | 105 | Ni | 1.0 | 0.89 |
| | 80 | Sn | 0.03 | 22 | Ag | 0.3 | 315 | Ni | 1.0 | 0.89 |
| Target | | | 0.002≤ ≤0.2 | 1≤ ≤150 | | 0.001≤ ≤0.3 | 1≤ ≤330 | | 0.005≤ | 0.03≤ |

TABLE 17-continued

| | | Heat Treatment Condition | Inserting Force Maximum Inserting Force/Maximum Inserting Force of Comparative Example 1 [%] | Contact Resistance [mΩ] | Gas Corrosion Resistance: Heat Resistance Contact Resistance [mΩ] | Gas Corrosion Resistance: Salt Spray Contact Resistance [mΩ] | Gas Corrosion Resistance: Sulfurous Acid Gas Contact Resistance [mΩ] | Gas Corrosion Resistance: Hydrogen Sulfide Contact Resistance [mΩ] | Generation Situation of Powder |
|---|---|---|---|---|---|---|---|---|---|
| Example | 3 | None | 77 | 1-3 | 1-4 | 1-4 | 1-4 | 1-4 | Good |
| | 77 | None | 73 | 1-3 | 6-9 | 1-4 | 1-4 | 1-4 | Good |
| | 78 | None | 74 | 1-3 | 2-5 | 1-4 | 1-4 | 1-4 | Good |
| | 79 | None | 78 | 1-3 | 1-4 | 1-4 | 1-4 | 1-4 | Good |
| | 80 | None | 84 | 1-3 | 1-3 | 1-4 | 1-4 | 1-4 | Average |
| Target | | | <85 | ≤10 | ≤10 | ≤10 | ≤10 | ≤10 | Average or higher |

TABLE 18

| | | A Layer: Composition | A Layer: Thickness [μm] | A Layer: Deposition Amount [μg/cm$^2$] | B Layer: Composition | B Layer: Thickness [μm] | B Layer: Deposition Amount [μg/cm$^2$] | C Layer: Composition | C Layer: Thickness [μm] | C Layer: Deposition Amount [mg/cm$^2$] |
|---|---|---|---|---|---|---|---|---|---|---|
| Example | 3 | Sn | 0.03 | 22 | Ag | 0.03 | 32 | Ni | 1.0 | 0.9 |
| | 81 | Sn | 0.03 | 22 | Ag | 0.03 | 32 | Ni (semi-bright) | 1.0 | 0.9 |
| | 82 | Sn | 0.03 | 22 | Ag | 0.03 | 32 | Ni (bright) | 1.0 | 0.9 |
| | 64 | Sn | 0.03 | 22 | Ag | 0.03 | 32 | Ni—P | 1.0 | 0.9 |
| | 83 | Sn | 0.03 | 22 | Ag | 0.03 | 32 | Ni (semi-bright) | 0.8 | 0.7 |
| | 84 | Sn | 0.03 | 22 | Ag | 0.03 | 32 | Ni (semi-bright) | 0.5 | 0.4 |
| | 85 | Sn | 0.03 | 22 | Ag | 0.03 | 32 | Ni (bright) | 0.6 | 0.5 |
| | 86 | Sn | 0.03 | 22 | Ag | 0.03 | 32 | Ni (bright) | 0.3 | 0.3 |
| | 87 | Sn | 0.03 | 22 | Ag | 0.03 | 32 | Ni—P | 0.2 | 0.2 |
| | 88 | Sn | 0.03 | 22 | Ag | 0.03 | 32 | Ni—P | 0.05 | 0.04 |
| Target | | | 0.002≤ ≤0.2 | 1≤ ≤150 | | 0.001≤ ≤0.3 | 1≤ ≤330 | | 0.005≤ | 0.03≤ |

| | | C Layer: Vickers Hardness: Hv | C Layer: Vickers Hardness: Correlation between Vickers Hardness and Expression Expression: −376.22Ln (thickness) + 86.411 | C Layer: Indentation Hardness: [MPa] | C Layer: Indentation Hardness: Correlation between Indentation Hardness and Expression Expression: −3998.4Ln (thickness) + 1178.9 | Heat Treatment Condition | Inserting Force Maximum Inserting Force/Maximum Inserting Force of Comparative Example 1 [%] | Generation Situation of Powder |
|---|---|---|---|---|---|---|---|---|
| Example | 3 | 130 | 86.4 ⇒ Vickers Hardness ≥ Expression | 1500 | 1178.9 ⇒ Indentation Hardness ≥ Expression | None | 77 | Good |
| | 81 | 300 | 86.4 ⇒ Vickers Hardness ≥ Expression | 3400 | 1178.9 ⇒ Indentation Hardness ≥ Expression | None | 74 | Good |
| | 82 | 500 | 86.4 ⇒ Vickers Hardness ≥ Expression | 5500 | 1178.9 ⇒ Indentation Hardness ≥ Expression | None | 70 | Good |
| | 64 | 1200 | 86.4 ⇒ Vickers Hardness ≥ Expression | 13000 | 1178.9 ⇒ Indentation Hardness ≥ Expression | None | 66 | Good |
| | 83 | 300 | 170.4 ⇒ Vickers Hardness ≥ Expression | 3400 | 2071.1 ⇒ Indentation Hardness ≥ Expression | None | 75 | Good |
| | 84 | 300 | 347.2 ⇒ Vickers Hardness < Expression | 3400 | 3950.4 ⇒ Indentation Hardness < Expression | None | 79 | Good |
| | 85 | 500 | 278.6 ⇒ Vickers Hardness ≥ Expression | 5500 | 3221.4 ⇒ Indentation Hardness ≥ Expression | None | 76 | Good |
| | 86 | 500 | 539.4 ⇒ Vickers Hardness < Expression | 5500 | 5992.9 ⇒ Indentation Hardness < Expression | None | 81 | Good |

TABLE 18-continued

| | | | | | | | | |
|---|---|---|---|---|---|---|---|---|
| | 87 | 1200 | 691.9 ⇒ Vickers Hardness ≥ Expression | 13000 | 7614.1 ⇒ Indentation Hardness ≥ Expression | None | 76 | Good |
| | 88 | 1200 | 1213.5 ⇒ Vickers Hardness < Expression | 13000 | 13157.0 ⇒ Indentation Hardness < Expression | None | 83 | Good |
| Target | | | | | | | <85 | Average or higher |

TABLE 19

| | | A Layer | | | B Layer | | | |
|---|---|---|---|---|---|---|---|---|
| | | Composition | Thickness [μm] | Deposition Amount [μg/cm$^2$] | Composition | Thickness [μm] | Deposition Amount [μg/cm$^2$] | C Layer Composition |
| Example | 3 | Sn | 0.03 | 22 | Ag | 0.03 | 32 | Ni |
| | 81 | Sn | 0.03 | 22 | Ag | 0.03 | 32 | Ni (semi-bright) |
| | 82 | Sn | 0.03 | 22 | Ag | 0.03 | 32 | Ni (bright) |
| | 64 | Sn | 0.03 | 22 | Ag | 0.03 | 32 | Ni—P |
| Target | | | 0.002≤ ≤0.2 | 1≤ ≤150 | | 0.001≤ ≤0.3 | 1≤ ≤330 | |

| | C Layer | | | | | |
|---|---|---|---|---|---|---|
| | Thickness [μm] | Deposition Amount [mg/cm$^2$] | Vickers Hardness Hv | Indentation Hardness [MPa] | Heat Treatment Condition | Bending Workability |
| Example3 | 1.0 | 0.9 | 130 | 1500 | None | Good |
| 81 | 1.0 | 0.9 | 300 | 3400 | None | Good |
| 82 | 1.0 | 0.9 | 600 | 6700 | None | Good |
| 64 | 1.0 | 0.9 | 1200 | 13000 | None | Poor |
| Target | 0.005≤ | 0.03≤ | | | | |

TABLE 20

| | | A Layer | | | B Layer | | | C Layer | | | |
|---|---|---|---|---|---|---|---|---|---|---|---|
| | | Composition | Thickness [μm] | Deposition Amount [μg/cm$^2$] | Composition | Thickness [μm] | Deposition Amount [μg/cm$^2$] | Composition | Thickness [μm] | Deposition Amount [mg/cm$^2$] | Heat Treatment Condition |
| Example | 3 | Sn | 0.03 | 22 | Ag | 0.03 | 32 | Ni | 1.0 | 0.9 | None |
| | 77 | Sn | 0.03 | 22 | Ag | 0.001 | 1.1 | Ni | 1.0 | 0.9 | None |
| | 5 | Sn | 0.002 | 2 | Ag | 0.001 | 1.1 | Ni | 1.0 | 0.9 | None |
| | 89 | Sn | 0.03 | 22 | Ag | 0.03 | 32 | Ni | 1.0 | 0.9 | 300° C. × 5 sec. |
| | 90 | Sn | 0.03 | 22 | Ag | 0.03 | 32 | Ni | 1.0 | 0.9 | 300° C. × 20 sec. |
| Comparative Example | 16 | Sn | 0.001 | 0.7 | Ag | 0.001 | 1.1 | Ni | 1.0 | 0.9 | None |
| | 19 | Sn | 0.03 | 22 | | | | Ni | 1.0 | 0.9 | None |
| Target | | | 0.002≤ ≤0.2 | 1≤ ≤150 | | 0.001≤ ≤0.3 | 1≤ ≤330 | | 0.005≤ | 0.03≤ | |

| | | XPS (Depth) Thickness of (Region) Having a Concentration of Ag, Au, Pt, Pd, Ru, Rh, Os, Ir of 40 at % or higher between $D_1$ and $D_3$ [nm] | XPS (Survey) Concentration of Sn, In of Outermost Surface [at] | Concentration of Ag, Au, Pt, Pd, Ru, Rh, Os, Ir of Outermost Surface [at %] | Concentration of O of Outermost Surface [at %] | Contact Resistance [mΩ] | Heat Resistance Contact Resistance [mΩ] | Gas Corrosion Resistance: Salt Spray Contact Resistance [mΩ] | Sulfurous Acid Gas Contact Resistance [mΩ] | Hydrogen Sulfide Contact Resistance [mΩ] |
|---|---|---|---|---|---|---|---|---|---|---|
| Example | 3 | 30 | 7.3 | 2.6 | 24.1 | 1-3 | 1-4 | 1-4 | 1-4 | 1-4 |
| | 77 | 1 | 7.4 | 2.1 | 25.1 | 1-3 | 3-6 | 1-4 | 1-4 | 1-4 |
| | 5 | 1 | 3.4 | 2.5 | 35.1 | 1-3 | 3-6 | 4-7 | 5-8 | 6-9 |

TABLE 20-continued

| | | | | | | | | | | |
|---|---|---|---|---|---|---|---|---|---|---|
| | 89 | 30 | 4.1 | 1.7 | 38.2 | 1-3 | 1-4 | 1-4 | 1-4 | 1-4 |
| | 90 | 30 | 2.2 | 1.2 | 57.1 | 3-5 | 3-6 | 3-5 | 3-5 | 3-5 |
| Comparative | 16 | 1 | 1.2 | 2.5 | 24.1 | 1-3 | | | | <10 |
| Example | 19 | | 7.3 | | 25.1 | 1-3 | <10 | | | |
| Target | | | | | | ≤10 | ≤10 | ≤10 | ≤10 | ≤10 |

TABLE 21

| | | A Layer | | | B Layer | | | C Layer | | |
|---|---|---|---|---|---|---|---|---|---|---|
| | | Composition | Thickness [μm] | Deposition Amount [μg/cm$^2$] | Composition | Thickness [μm] | Deposition Amount [μg/cm$^2$] | Composition | Thickness [μm] | Deposition Amount [mg/cm$^2$] |
| Example | 91 | Sn | 0.03 | 22 | Ag—10Sn | 0.03 | 32 | Ni | 1.0 | 0.9 |
| | 92 | Sn | 0.03 | 22 | Ag—40Sn | 0.03 | 32 | Ni | 1.0 | 0.9 |
| | 93 | Sn—Ag5 | 0.03 | 22 | Ag | 0.03 | 32 | Ni | 1.0 | 0.9 |
| | 94 | Sn—Ag40 | 0.03 | 22 | Ag | 0.03 | 32 | Ni | 1.0 | 0.9 |
| Target | | | 0.002≤ ≤0.2 | 1≤ ≤150 | | 0.001≤ ≤0.3 | 1≤ ≤330 | | 0.005≤ | 0.03≤ |

| | | Heat Treatment Condition | Inserting Force Maximum Inserting Force/Maximum Inserting Force of Comparative Example 1 [%] | Contact Resistance [mΩ] | Gas Corrosion Resistance: Heat Resistance Contact Resistance [mΩ] | Salt Spray Contact Resistance [mΩ] | Sulfurous Acid Gas Contact Resistance [mΩ] | Hydrogen Sulfide Contact Resistance [mΩ] | Generation Situation of Powder |
|---|---|---|---|---|---|---|---|---|---|
| Example | 91 | None | 78 | 1-3 | 1-4 | 1-4 | 1-4 | 1-4 | Good |
| | 92 | None | 77 | 1-3 | 1-4 | 1-4 | 1-4 | 1-4 | Good |
| | 93 | None | 75 | 1-3 | 1-4 | 1-4 | 1-4 | 1-4 | Good |
| | 94 | None | 72 | 1-3 | 1-4 | 1-4 | 1-4 | 1-4 | Good |
| Target | | | <85 | ≤10 | ≤10 | ≤10 | ≤10 | ≤10 or higher | Average |

TABLE 22

| | | A Layer | | | B Layer | | | C Layer | | |
|---|---|---|---|---|---|---|---|---|---|---|
| | | Composition | Thickness [μm] | Deposition Amount [μg/cm$^2$] | Composition | Thickness [μm] | Deposition Amount [μg/cm$^2$] | Composition | Thickness [μm] | Deposition Amount [mg/cm$^2$] |
| Example | 95 | Sn | 0.03 | 22 | Ag | 0.03 | 32 | Ni | 1.0 | 0.9 |
| | 96 | Sn | 0.03 | 22 | Ag | 0.03 | 32 | Ni | 1.0 | 0.9 |
| | 97 | Sn | 0.03 | 22 | Ag | 0.03 | 32 | Ni | 1.0 | 0.9 |
| | 98 | Sn | 0.03 | 22 | Ag | 0.03 | 32 | Ni | 1.0 | 0.9 |
| | 99 | Sn | 0.03 | 22 | Ag | 0.03 | 32 | Ni | 1.0 | 0.9 |
| | 100 | Sn | 0.03 | 22 | Ag | 0.03 | 32 | Ni | 1.0 | 0.9 |
| | 101 | Sn | 0.03 | 22 | Ag | 0.03 | 32 | Ni | 1.0 | 0.9 |
| Target | | | 0.002≤ ≤0.2 | 1≤ ≤150 | | 0.001≤ ≤0.3 | 1≤ ≤330 | | 0.005≤ | 0.03≤ |

| | | Heat Treatment Condition | Inserting Force Maximum Inserting Force/Maximum Inserting Force of Comparative Example 1 [%] | Contact Resistance [mΩ] | Gas Corrosion Resistance: Heat Resistance Contact Resistance [mΩ] | Salt Spray Contact Resistance [mΩ] | Sulfurous Acid Gas Contact Resistance [mΩ] | Hydrogen Sulfide Contact Resistance [mΩ] |
|---|---|---|---|---|---|---|---|---|
| Example | 95 | None | 77 | 1-3 | 1-4 | 1-4 | 1-4 | 1-4 |
| | 96 | 30° C. × 12 h | 76 | 1-3 | 1-4 | 1-4 | 1-4 | 1-4 |
| | 97 | 50° C. × 12 h | 73 | 1-3 | 1-4 | 1-4 | 1-4 | 1-4 |
| | 98 | 50° C. × 20 h | 72 | 3-5 | 3-7 | 1-4 | 1-4 | 1-4 |
| | 99 | 300° C. × 3 sec. | 73 | 1-3 | 1-4 | 1-4 | 1-4 | 1-4 |

TABLE 22-continued

| | | | | | | | |
|---|---|---|---|---|---|---|---|
| 100 | 500° C. × 1 sec. | 72 | 1-3 | 1-4 | 1-4 | 1-4 | 1-4 |
| 101 | 600° C. × 1 sec. | 73 | 3-5 | 3-7 | 1-4 | 1-4 | 1-4 |
| Target | | <85 | ≤10 | ≤10 | ≤10 | ≤10 | ≤10 |

Examples 1 to 101 were press-fit terminals, which had the excellent whisker resistance and the low inserting force, were unlikely to cause shaving of plating when the press-fit terminal was inserted into the substrate, and had the high heat resistance.

Comparative Example 1 is a blank material.

Comparative Example 2 was fabricated by making thin the Sn plating of the blank material of Comparative Example 1, but generated whiskers thereby to be poor in the whisker resistance.

Comparative Example 3 was fabricated by being subjected to no heat treatment, in comparison with Comparative Example 2, but generated whiskers thereby to be poor in the whisker resistance, and was higher in the inserting force than the target.

Comparative Example 4 was fabricated by carrying out Cu plating for the C layer, in comparison with Comparative Example 2, but had the inserting force of 90% of Comparative Example 1, which was higher than the target, and was poor in the heat resistance.

Comparative Example 5 was fabricated by making the Sn plating thin, in comparison with Comparative Example 4, but generated whiskers thereby to be poor in the whisker resistance.

Comparative Example 6 was fabricated by being subjected to no heat treatment, in comparison with Comparative Example 5, but generated whiskers thereby to be poor in the whisker resistance, and was higher in the inserting force than the target.

Comparative Example 7 was fabricated by being subjected to Cu plating for the C layer, in comparison with the blank material of Comparative Example 1, but exhibited no variations in the properties in comparison with Comparative Example 1.

Comparative Example 8 was fabricated by making the Ni plating of the C layer thick in comparison with the blank material of Comparative Example 1, but exhibited no variations in the properties in comparison with Comparative Example 1.

Comparative Example 9 was fabricated by making the Sn plating of the outermost surface layer thick in comparison with Example 1, but surely generated one or more whiskers of shorter than 20 μm though there was no whiskers of 20 μm or longer in length, which was the target.

Comparative Example 10 was fabricated by making the Ag plating of the B layer thin in comparison with Comparative Example 9, but surely generated one or more whiskers of shorter than 20 μm though there was no whisker of 20 μm or longer in length, which was the target.

Comparative Example 11 was fabricated by making the Ag plating of the B layer thick in comparison with Example 1, but provided a large amount of powder generated.

Comparative Example 12 was fabricated by carrying out no Ag plating of the B layer in comparison with Comparative Example 11, but was poor in the heat resistance.

Comparative Example 13 was fabricated by making the Ag plating of the B layer thick in comparison with Example 4, but provided a large amount of powder generated.

Comparative Example 14 was fabricated by carrying out no Ag plating of the B layer in comparison with Comparative Example 13, but was poor in the heat resistance.

Comparative Example 15 was fabricated by making the Sn plating of the A layer thin in comparison with Example 4, but was poor in the gas corrosion resistance, and higher in the contact resistance after the hydrogen sulfide gas corrosion test than the target.

Comparative Example 16 was fabricated by making the Sn plating of the A layer thin in comparison with Example 5, but had a maximum value of the atomic concentration (at %) of Sn or In of the A layer of 10 at % or lower in a depth measurement by XPS (X-ray photoelectron spectroscopy), was poor in the gas corrosion resistance, and higher in the contact resistance after the hydrogen sulfide gas corrosion test than the target.

Comparative Example 17 was fabricated by reversing the plating order of Sn and Ag in comparison with Example 3, but was poor in the gas corrosion resistance and higher in the contact resistance after the hydrogen sulfide gas corrosion test than the target, because in a depth measurement by XPS (X-ray photoelectron spectroscopy), the position ($D_1$) where the atomic concentration (at %) of Sn or In of the A layer was the maximum value and the position ($D_2$) where the atomic concentration (at %) of Ag, Au, Pt, Pd, Ru, Rh, Os, or Ir of the B layer was the maximum value were present in the order of $D_2$ and $D_1$.

Comparative Example 18 was fabricated by making the Ni plating thin in comparison with Example 3, but had the high inserting force, and was poor in the heat resistance, because in a depth measurement by XPS (X-ray photoelectron spectroscopy), a depth where the atomic concentration (at %) of Ni, Cr, Mn, Fe, Co, or Cu of the C layer was 25 at % or higher was shallower than 50 nm.

Comparative Example 19 was poor in the heat resistance, because Sn of the A layer was thin, and the B layer was not formed.

FIG. 2 shows a depth measurement result by XPS (X-ray photoelectron spectroscopy) in Example 3. It is clear from FIG. 2 that the position ($D_1$) where the atomic concentration (at %) of Sn or In of the A layer was the maximum value and the position ($D_2$) where the atomic concentration (at %) of Ag, Au, Pt, Pd, Ru, Rh, Os, or Ir of the B layer was the maximum value were present in the order of $D_1$ and $D_2$; and $D_1$ had 35 at %, and $D_2$ had 87 at %.

Figure 3:
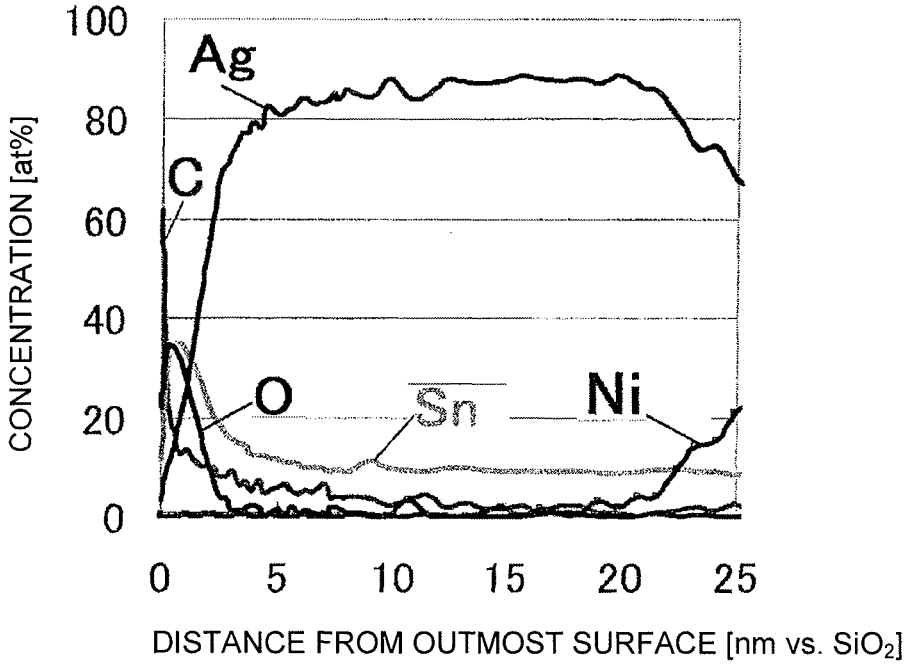
FIG. 3 is a depth measurement result by XPS (X-ray photoelectron spectroscopy) according to Example 3.
Figure 4:
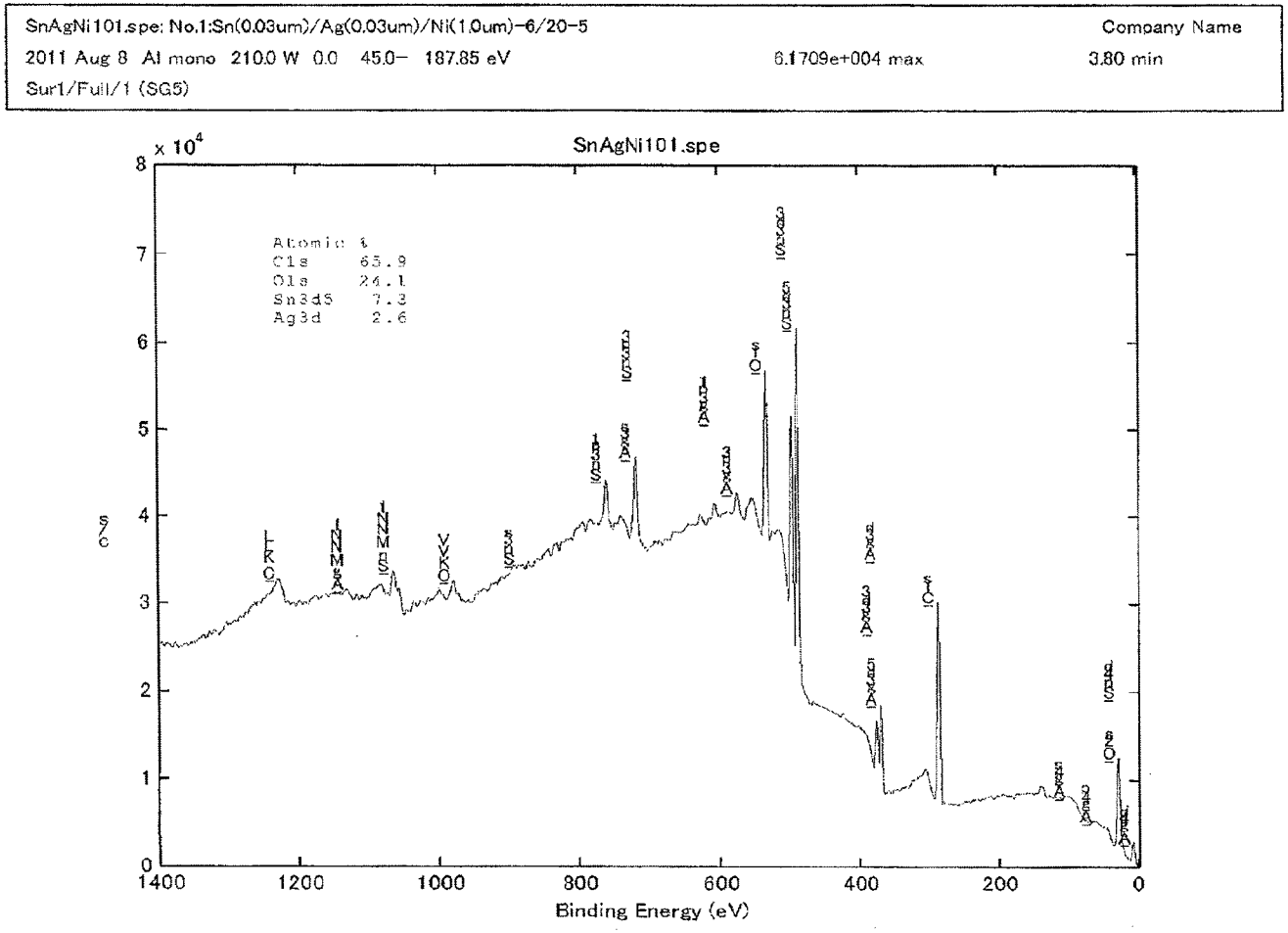
FIG. 4 is a survey measurement result by XPS (X-ray photoelectron spectroscopy) according to Example 3.

FIG. 3 shows a survey measurement result by XPS (X-ray photoelectron spectroscopy) in Example 3. It is clear from FIG. 3 that O was 24.1 at %; Ag was 2.6 at %; and Sn was 7.3 at %.

REFERENCE SIGNS LIST

10 METAL MATERIAL FOR PRESS-FIT TERMINAL
11 BASE MATERIAL
12 C LAYER
13 B LAYER
14 A LAYER

The invention claimed is:

1. A press-fit terminal comprising:

a female terminal connection part provided at one side of an attached part to be attached to a housing; and a substrate connection part provided at the other side and attached to a substrate by press-fitting the substrate connection part into a through-hole formed in the substrate, wherein at least the substrate connection part has the surface structure described below;

the surface structure comprises:

an A layer formed as an outermost surface layer and formed of Sn, In, or an alloy thereof;

a B layer formed below the A layer and constituted of one or two or more selected from the group consisting of Ag, Au, Pt, Pd, Ru, Rh, Os, and Ir; and a C layer formed below the B layer and constituted of one or two or more selected from the group consisting of Ni, Cr, Mn, Fe, Co, and Cu; wherein the A layer has a thickness of 0.002 to 0.2 μm, and a surface arithmetic average height (Ra) of 0.1 μm or lower;

the B layer has a thickness of 0.001 to 0.3 μm; and the C layer has a thickness of 0.05 μm or larger.

2. The press-fit terminal according claim 1, wherein the A layer has a thickness of 0.01 to 0.1 μm, and the press-fit terminal has a low inserting force and causes less shaving of plating.

3. The press-fit terminal according to claim 1, wherein the B layer has a thickness of 0.005 to 0.1 μm, and the press-fit terminal has a low inserting force and causes less shaving of plating.

4. A press-fit terminal comprising:

a female terminal connection part provided at one side of an attached part to be attached to a housing; and a substrate connection part provided at the other side and attached to a substrate by press-fitting the substrate connection part into a through-hole formed in the substrate, wherein at least the substrate connection part has the surface structure described below;

the surface structure comprises:

an A layer formed as an outermost surface layer and formed of Sn, In, or an alloy thereof;

a B layer formed below the A layer and constituted of one or two or more selected from the group consisting of Ag, Au, Pt, Pd, Ru, Rh, Os, and Ir; and a C layer formed below the B layer and constituted of one or two or more selected from the group consisting of Ni, Cr, Mn, Fe, Co, and Cu; wherein the A layer has a deposition amount of Sn, In of 1 to 150 $\mu g/cm^2$, and a surface arithmetic average height (Ra) of 0.1 μm or lower;

the B layer has a deposition amount of Ag, Au, Pt, Pd, Ru, Rh, Os, Ir of 1 to 330 $\mu g/cm^2$; and the C layer has a deposition amount of Ni, Cr, Mn, Fe, Co, Cu of 0.03 $mg/cm^2$ or larger.

5. The press-fit terminal according to claim 4, wherein the A layer has a deposition amount of Sn, In of 7 to 75 $\mu g/cm^2$, and the press-fit terminal has a low inserting force and causes less shaving of plating.

6. The press-fit terminal according to claim 4, wherein the B layer has a deposition amount of Ag, Au, Pt, Pd, Ru, Rh, Os, Ir of 4 to 120 $\mu g/cm^2$, and the press-fit terminal has a low inserting force and causes less shaving of plating.

7. The press-fit terminal according to claim 1 or 4, wherein the A layer has an alloy composition comprising 50 mass % or more of Sn, In, or a total of Sn and In, and the other alloy component(s) comprising one or two or more metals selected from the group consisting of Ag, As, Au, Bi, Cd, Co, Cr, Cu, Fe, In, Mn, Mo, Ni, Pb, Sb, Sn, W, and Zn.

8. The press-fit terminal according claim 1 or 4, wherein the B layer has an alloy composition comprising 50 mass % or more of Ag, Au, Pt, Pd, Ru, Rh, Os, Ir, or a total of Ag, Au, Pt, Pd, Ru, Rh, Os, and Ir, and the other alloy component(s) comprising one or two or more metals selected from the group consisting of Ag, Au, Bi, Cd, Co, Cu, Fe, In, Ir, Mn, Mo, Ni, Pb, Pd, Pt, Rh, Ru, Sb, Se, Sn, W, Tl, and Zn.

9. The press-fit terminal according to claim 1 or 4, wherein the C layer has an alloy composition comprising 50 mass % or more of a total of Ni, Cr, Mn, Fe, Co, and Cu, and further comprising one or two or more selected from the group consisting of B, P, Sn, and Zn.

10. The press-fit terminal according to claim 1 or 4, wherein the A layer has a surface indentation hardness of 1,000 MPa or higher.

11. The press-fit terminal according to claim 1 or 4, wherein the A layer has a surface indentation hardness of 10,000 MPa or lower.

12. The press-fit terminal according to claim 1 or 4, wherein when a depth analysis by XPS (X-ray photoelectron spectroscopy) is carried out, a position ($D_1$) where an atomic concentration (at %) of Sn or In of the A layer is a maximum value, a position ($D_2$) where an atomic concentration (at %) of Ag, Au, Pt, Pd, Ru, Rh, Os, or Ir of the B layer is a maximum value, and a position ($D_3$) where an atomic concentration (at %) of Ni, Cr, Mn, Fe, Co, or Cu of the C layer is a maximum value are present in the order of $D_1$, $D_2$, and $D_3$ from the outermost surface.

13. The press-fit terminal according to claim 1 or 4, wherein the press-fit terminal is fabricated by forming surface-treated layers on the substrate connection part in the order of the C layer, the B layer, and the A layer by a surface treatment, and thereafter heat-treating the surface-treated layers.

14. An electronic component comprising a press-fit terminal according to claim 1 or 4.

* * * * *